US007476830B2

(12) United States Patent
Middleton et al.

(10) Patent No.: US 7,476,830 B2
(45) Date of Patent: Jan. 13, 2009

(54) MICROWAVE PACKAGING FOR MULTICOMPONENT MEALS

(75) Inventors: Scott W. Middleton, Oshkosh, WI (US); Lorin R. Cole, Larsen, WI (US); Patrick H. Wnek, Sherwood, WI (US)

(73) Assignee: Graphic Packaging International, Inc., Marietta, GA (US)

( * ) Notice: Subject to any disclaimer, the term of this patent is extended or adjusted under 35 U.S.C. 154(b) by 0 days.

(21) Appl. No.: 11/440,921

(22) Filed: May 25, 2006

(65) Prior Publication Data

US 2006/0289522 A1 Dec. 28, 2006

Related U.S. Application Data

(60) Provisional application No. 60/684,490, filed on May 25, 2005.

(51) Int. Cl.
*H05B 6/80* (2006.01)
*B65D 81/34* (2006.01)

(52) U.S. Cl. ..... 219/729; 219/730; 219/762; 99/DIG. 14; 426/109; 426/234; 426/243

(58) Field of Classification Search ..... 219/621, 219/725–735, 759, 762; 426/107, 109, 118, 426/234, 241, 243; 49/DIG. 14
See application file for complete search history.

(56) References Cited

U.S. PATENT DOCUMENTS

| | | | | |
|---|---|---|---|---|
| 3,302,632 | A | 2/1967 | Fichtner | |
| 3,547,661 | A | 12/1970 | Stevenson | |
| 3,615,713 | A * | 10/1971 | Stevenson | 426/107 |
| 3,865,301 | A | 2/1975 | Pothier et al. | |
| 3,936,626 | A | 2/1976 | Moore | |
| 4,013,798 | A | 3/1977 | Goltsos | |
| 4,020,310 | A * | 4/1977 | Souder et al. | 219/621 |
| 4,574,174 | A * | 3/1986 | McGonigle | 219/735 |
| 4,676,857 | A | 6/1987 | Scharr et al. | |
| 4,775,771 | A | 10/1988 | Pawlowski | |
| 4,865,921 | A | 9/1989 | Hollenberg | |
| 4,890,439 | A | 1/1990 | Smart | |
| 4,936,935 | A | 6/1990 | Beckett | |
| 4,963,424 | A | 10/1990 | Beckett | |
| 5,093,364 | A | 3/1992 | Richards | |
| 5,117,078 | A | 5/1992 | Beckett | |
| 5,149,396 | A | 9/1992 | Wilson | |
| 5,213,902 | A | 5/1993 | Beckett | |
| 5,221,419 | A | 6/1993 | Beckett | |
| 5,239,153 | A | 8/1993 | Beckett | |
| 5,260,537 | A | 11/1993 | Beckett | |
| 5,266,386 | A | 11/1993 | Beckett | |
| 5,317,119 | A | 5/1994 | Ayres | |
| RE34,683 | E | 8/1994 | Maynard | |
| 5,340,436 | A | 8/1994 | Beckett | |

(Continued)

FOREIGN PATENT DOCUMENTS

| | | |
|---|---|---|
| EP | 0 317 203 A1 | 5/1989 |

(Continued)

*Primary Examiner*—Philip H Leung
(74) *Attorney, Agent, or Firm*—Womble Carlyle Sandridge & Rice, PLLC

(57) ABSTRACT

Various constructs are provided for heating a plurality of different food items to their respective desired serving temperatures in a microwave oven in about the same amount of time.

19 Claims, 14 Drawing Sheets

U.S. PATENT DOCUMENTS

| | | | | |
|---|---|---|---|---|
| 5,354,973 | A | 10/1994 | Beckett | |
| 5,410,135 | A | 4/1995 | Pollart | |
| 5,424,517 | A | 6/1995 | Habeger | |
| 5,428,209 | A * | 6/1995 | Babu et al. | 219/730 |
| 5,519,195 | A | 5/1996 | Keefer | |
| 5,628,921 | A | 5/1997 | Beckett | |
| 5,672,407 | A | 9/1997 | Beckett | |
| 5,759,422 | A | 6/1998 | Schmelzer | |
| 5,800,724 | A | 9/1998 | Habeger | |
| 5,858,487 | A | 1/1999 | Boehler et al. | |
| 5,864,123 | A | 1/1999 | Keefer | |
| 5,910,268 | A | 6/1999 | Keefer | |
| 6,114,679 | A | 9/2000 | Lai | |
| 6,150,646 | A | 11/2000 | Lai | |
| 6,204,492 | B1 * | 3/2001 | Zeng et al. | 219/728 |
| 6,251,451 | B1 | 6/2001 | Zeng | |
| 6,414,290 | B1 | 7/2002 | Cole | |
| 6,433,322 | B2 | 8/2002 | Zeng | |
| 6,455,827 | B2 | 9/2002 | Zeng | |
| 6,552,315 | B2 | 4/2003 | Zeng | |
| 6,677,563 | B2 | 1/2004 | Lai | |
| 6,717,121 | B2 | 4/2004 | Zeng | |
| 6,765,182 | B2 | 7/2004 | Cole | |
| 7,019,271 | B2 * | 3/2006 | Wnek et al. | 219/730 |
| 2004/0108313 | A1 * | 6/2004 | Cutler et al. | 219/730 |
| 2006/0049190 | A1 | 3/2006 | Middleton | |
| 2006/0289521 | A1 * | 12/2006 | Bohme et al. | 219/730 |
| 2006/0289522 | A1 | 12/2006 | Middleton et al. | |

FOREIGN PATENT DOCUMENTS

| | | | |
|---|---|---|---|
| EP | 0 336 325 | A2 | 10/1989 |
| GB | 2 280 342 | A | 1/1995 |
| WO | WO 03/066435 | A2 | 8/2003 |

* cited by examiner

MICROWAVE PACKAGING FOR MULTICOMPONENT MEALS

CROSS-REFERENCE TO RELATED APPLICATION

This application claims the benefit of U.S. Provisional Application No. 60/684,490, filed May 25, 2005, which is incorporated by reference herein in its entirety.

TECHNICAL FIELD

The present invention relates to various materials, packages, constructs, and systems for heating or cooking a food item in a microwave oven. In particular, the invention relates to various materials, packages, constructs, and systems for heating or cooking multiple food items concurrently in a microwave oven, where at least two of such items respond differently to microwave energy.

BACKGROUND

Multicomponent microwave entrees typically have been limited to selections of food items that heat at a similar rate in a microwave oven so they reach the desired temperature in the same amount of time. As compared with frozen solid food items, frozen liquid food items, such as frozen beverages and soups, require a relatively large amount of microwave energy and time to thaw and reach serving temperature, which typically is about 160° F. to 200° F. For this reason, such food items typically are not included in microwave entrees. Thus, there remains a need for microwave packages or other constructs that provide even heating of various types of food items, for example, frozen liquid food items and frozen solid food items, to be heated together in a microwave oven.

SUMMARY

The present invention is directed generally to various trays, packages, systems, or other constructs (collectively "constructs"), various methods of making such constructs, and various methods of heating, browning, and/or crisping at least one food item in a microwave oven. For example, the various constructs contemplated by the invention may be used to heat a plurality of food items concurrently, where at least two of the food items respond differently to microwave energy. To do so, the construct may include one or more features that allow the plurality of food items to reach their respective desired serving temperatures in substantially the same amount of time. As used herein, "desired serving temperature" refers to a desired heating temperature, a desired consumption temperature, or any temperature therebetween. Thus, it will be understood that the although the desired heating temperature may be slightly higher or lower than the desired serving temperature, both of such temperatures and the temperatures therebetween are encompassed by the term "desired serving temperature" or simply "desired temperature".

By way of example, and not limitation, the construct may include features that allow a frozen liquid food item to be heated to a desired serving temperature in substantially the same amount of time as a frozen non-liquid food item. Some of such features selectively reflect, absorb, or direct microwave energy. Additionally, the construct may include portions that are transparent to microwave energy.

In one aspect, a construct for heating a plurality of food items in a microwave oven comprises a base and at least one upstanding wall at least partially defining a plurality of compartments. The plurality of compartments may include a first compartment comprising a first microwave energy interactive element and a second compartment comprising a second microwave energy interactive element. The first microwave energy interactive element and the second microwave energy interactive element may be selected so that a plurality of food items within the first compartment and the second compartment independently are heated to their desired respective temperatures in substantially the same amount of time.

The first microwave energy interactive element may comprise a segmented foil, a shielding element, a microwave energy interactive insulating material, or any combination thereof. If desired, the first compartment may be configured to receive a solid food item in a frozen state. For example, the first compartment may be configured to receive a dough-based food item or a breaded food item, such as a sandwich or a breaded chicken patty.

The second microwave energy interactive element may comprise a susceptor, a susceptor having at least one aperture therethrough, a segmented foil at least partially overlying a susceptor, or any combination thereof. The aperture may be a physical aperture or a non-physical aperture, for example, a chemically deactivated region of the susceptor. The second compartment may be configured to receive a liquid food item in a frozen state. For example, the second compartment may be configured to receive a beverage, soup, sauce, or gravy. In one variation, the first compartment is configured to receive a sandwich and the second compartment is configured to receive a soup.

If desired, the construct may include an overwrap overlying at least one of the first compartment and the second compartment, where the overwrap comprises a third microwave energy interactive element overlying at least a portion of a polymeric film. In one example, the third microwave energy interactive element overlies the first compartment. The third microwave energy interactive element may comprise a segmented foil, a susceptor, any combination thereof, or any other suitable microwave energy interactive element.

According to another aspect of the invention, a packaging system is provided for heating a plurality of food items in a microwave oven. The system comprises a tray including a base and at least one upstanding wall at least partially defining at least a first compartment and a second compartment, a first microwave energy interactive element at least partially overlying and at least partially joined to the first compartment of the tray, and a container dimensioned to be seated removably within the second compartment of the tray. The container may include a second microwave energy interactive element that may be of the same type as the first microwave energy interactive element, or may be of a different type than the first microwave energy interactive element.

The first compartment may be configured to receive a first food item having an outer surface to be browned and/or crisped, for example, a dough-based food item, such as a sandwich, or a breaded food item. In such an example, the first microwave energy interactive element may comprise a susceptor, a susceptor having at least one aperture therethrough, or a segmented foil at least partially overlying a susceptor, or any combination thereof.

The container that is capable of being seated within the second compartment may be configured to receive a food item that is consumed in a liquid or semi-liquid state, for example, a beverage, soup, sauce, or gravy. In such an example, the second microwave energy interactive element may comprise a segmented foil at least partially overlying a susceptor, a susceptor, or a susceptor having at least one aperture therethrough. The aperture may be a physical aperture or a non-physical aperture, for example, a chemically deactivated region of the susceptor.

In one particular example, the first microwave energy interactive element comprises a shielding element, a segmented foil, or any combination thereof; the second microwave energy interactive element comprises a segmented foil, a susceptor, or any combination thereof; the first compartment is configured to receive a sandwich; and the container is configured to receive a soup. If desired, the various systems of the invention may include an overwrap overlying at least the first compartment, where the overwrap comprises a microwave energy interactive material supported on and at least partially overlying a polymeric film.

According to still another aspect of the present invention, a system is provided for heating a plurality of frozen food items in a microwave oven, where the food items each respond differently to microwave energy. The system comprises a tray having a plurality of compartments including at least a first compartment and a second compartment, a first container dimensioned to be received removably within the first compartment, and a second container dimensioned to be received within the second compartment. In this aspect, the first container may include a first microwave energy interactive element and the second container may include a second microwave energy interactive element. The first microwave energy interactive element may comprise a shielding element, a segmented foil, or any combination thereof. Likewise, the second microwave energy interactive element may comprise a segmented foil, a susceptor, or any combination thereof.

The first container and the second container may have any suitable configuration. In one example, the first container may be a flexible sleeve, pouch, or wrap, and may be configured to receive a food item having an outer surface that desirably is browned and/or crisped, for example, a dough-based food item, a breaded food item, or any combination thereof. Examples of such items include a sandwich, a breaded meat, a pastry, or the like. The second container may be, for example, a rigid or semi-rigid cup, and may be configured to receive a beverage, soup, sauce, or gravy.

In one particular example, the first container comprises a flexible sleeve, pouch, or wrap configured to receive a first frozen food item having a surface that desirably is browned and/or crisped when thawed, and the second container comprises a rigid or semi-rigid cup configured to receive a second food item that is consumed in a liquid or semi-liquid state. The first microwave energy interactive element and the second microwave energy interactive element are selected such that the first food item is browned and/or crisped and the second food item is brought to a liquid or semi-liquid state in about the same amount of time when heated in a microwave oven.

Additional aspects, features, and advantages of the present invention will become apparent from the following description and accompanying figures.

BRIEF DESCRIPTION OF THE DRAWINGS

The description refers to the accompanying drawings, some of which are schematic, in which like reference characters refer to like parts throughout the several views, and in which.

DESCRIPTION

I. Materials

Figure 1A:
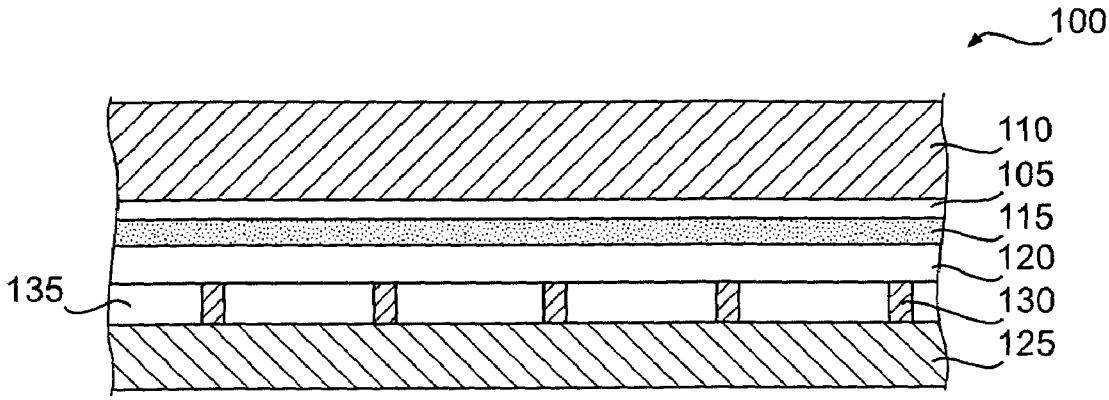
FIG. 1A depicts a schematic cross-sectional view of an exemplary microwave energy interactive insulating material that may be used to form a package in accordance with various aspects of the present invention.

Numerous materials may be suitable for use in forming the various constructs of the invention, provided that the materials are resistant to softening, scorching, combusting, or degrading at typical microwave oven heating temperatures, for example, at from about 250° F. to about 425° F. The particular materials used may include microwave energy interactive materials and microwave energy transparent or inactive materials.

A. Microwave Energy Interactive Elements

As stated above, the construct of the present invention may include features that alter the effect of microwave energy during the heating or cooking of the food item. For example, any of the constructs may be formed at least partially from one or more microwave energy interactive elements (hereinafter referred to as "microwave interactive elements" or "elements") that promote browning and/or crisping of a particular area of the food item, shield a particular area of the food item from microwave energy to prevent overcooking thereof, or transmit microwave energy towards or away from a particular area of the food item. Each microwave interactive element comprises one or more microwave energy interactive materials or segments arranged in a particular configuration to absorb microwave energy, transmit microwave energy, reflect microwave energy, or direct microwave energy, as needed or desired for a particular microwave heating construct and food item. The microwave interactive element may be supported on a microwave inactive or transparent substrate for ease of handling and/or to prevent contact between the microwave interactive material and the food item. As a matter of convenience and not limitation, and although it is understood that a microwave interactive element supported on a microwave transparent substrate includes both microwave interactive and microwave inactive elements or components, such constructs are referred to herein as "microwave interactive webs".

The microwave energy interactive material may be an electroconductive or semiconductive material, for example, a metal or a metal alloy provided as a metal foil; a vacuum deposited metal or metal alloy; or a metallic ink, an organic ink, an inorganic ink, a metallic paste, an organic paste, an inorganic paste, or any combination thereof. Examples of metals and metal alloys that may be suitable for use with the present invention include, but are not limited to, aluminum, chromium, copper, inconel alloys (nickel-chromium-molybdenum alloy with niobium), iron, magnesium, nickel, stainless steel, tin, titanium, tungsten, and any combination or alloy thereof.

Alternatively, the microwave energy interactive material may comprise a metal oxide. Examples of metal oxides that may be suitable for use with the present invention include, but are not limited to, oxides of aluminum, iron, and tin, used in conjunction with an electrically conductive material where needed. Another example of a metal oxide that may be suitable for use with the present invention is indium tin oxide (ITO). ITO can be used as a microwave energy interactive material to provide a heating effect, a shielding effect, a browning and/or crisping effect, or a combination thereof. For example, to form a susceptor, ITO may be sputtered onto a clear polymeric film. The sputtering process typically occurs at a lower temperature than the evaporative deposition process used for metal deposition. ITO has a more uniform crystal structure and, therefore, is clear at most coating thicknesses. Additionally, ITO can be used for either heating or field management effects. ITO also may have fewer defects than metals, thereby making thick coatings of ITO more suitable for field management than thick coatings of metals, such as aluminum.

Alternatively, the microwave energy interactive material may comprise a suitable electroconductive, semiconductive, or non-conductive artificial dielectric or ferroelectric. Artificial dielectrics comprise conductive, subdivided material in a polymeric or other suitable matrix or binder, and may include flakes of an electroconductive metal, for example, aluminum.

In one example, the microwave interactive element may comprise a thin layer of microwave interactive material that tends to absorb microwave energy, thereby generating heat at the interface with a food item. Such elements often are used to promote browning and/or crisping of the surface of a food item (sometimes referred to as a "browning and/or crisping element"). When supported on a film or other substrate, such an element may be referred to as a "susceptor film" or, simply, "susceptor".

As another example, the microwave interactive element may comprise a foil having a thickness sufficient to shield one or more selected portions of the food item from microwave energy (sometimes referred to as a "shielding element"). Such shielding elements may be used where the food item is prone to scorching or drying out during heating.

The shielding element may be formed from various materials and may have various configurations, depending on the particular application for which the shielding element is used. Typically, the shielding element is formed from a conductive, reflective metal or metal alloy, for example, aluminum, copper, or stainless steel. The shielding element generally may have a thickness of from about 0.000285 inches to about 0.05 inches. In one aspect, the shielding element has a thickness of from about 0.0003 inches to about 0.03 inches. In another aspect, the shielding element has a thickness of from about 0.00035 inches to about 0.020 inches, for example, 0.016 inches.

As still another example, the microwave interactive element may comprise a segmented foil, such as, but not limited to, those described in U.S. Pat. Nos. 6,204,492, 6,433,322, 6,552,315, and 6,677,563, each of which is incorporated by reference in its entirety. Although segmented foils are not continuous, appropriately spaced groupings of such segments often act as a transmitting element to direct microwave energy to specific areas of the food item. Such foils also may be used in combination with browning and/or crisping elements, for example, susceptors.

Any of the numerous microwave interactive elements described herein or contemplated hereby may be substantially continuous, that is, without substantial breaks or interruptions, or may be discontinuous, for example, by including one or more breaks or apertures that transmit microwave energy therethrough. The breaks or apertures may be sized and positioned to heat particular areas of the food item selectively. The number, shape, size, and positioning of such breaks or apertures may vary for a particular application depending on type of construct being formed, the food item to be heated therein or thereon, the desired degree of shielding, browning, and/or crisping, whether direct exposure to microwave energy is needed or desired to attain uniform heating of the food item, the need for regulating the change in temperature of the food item through direct heating, and whether and to what extent there is a need for venting.

It will be understood that the aperture may be a physical aperture or void in the material used to form the construct, or may be a non-physical "aperture". A non-physical aperture may be a portion of the construct that is microwave energy inactive by deactivation or otherwise, or one that is otherwise transparent to microwave energy. Thus, for example, the aperture may be a portion of the construct formed without a microwave energy active material or, alternatively, may be a portion of the construct formed with a microwave energy active material that has been deactivated. While both physical and non-physical apertures allow the food item to be heated directly by the microwave energy, a physical aperture also provides a venting function to allow steam or other vapors to be released from the food item.

As stated above, any of the above elements and numerous others contemplated hereby may be supported on a substrate. The substrate typically comprises an electrical insulator, for example, a film formed from a polymer or polymeric material. As used herein the term "polymer" or "polymeric material" includes, but is not limited to, homopolymers, copolymers, such as for example, block, graft, random, and alternating copolymers, terpolymers, etc. and blends and modifications thereof. Furthermore, unless otherwise specifically limited, the term "polymer" shall include all possible geometrical configurations of the molecule. These configurations include, but are not limited to isotactic, syndiotactic, and random symmetries.

The thickness of the film typically may be from about 35 gauge to about 10 mil. In one aspect, the thickness of the film is from about 40 to about 80 gauge. In another aspect, the thickness of the film is from about 45 to about 50 gauge. In still another aspect, the thickness of the film is about 48 gauge. Examples of polymeric films that may be suitable include, but are not limited to, polyolefins, polyesters, polyamides, polyimides, polysulfones, polyether ketones, cellophanes, or any combination thereof. Other non-conducting substrate materials such as paper and paper laminates, metal oxides, silicates, cellulosics, or any combination thereof, also may be used.

In one example, the polymeric film comprises polyethylene terephthalate (PET). Polyethylene terephthalate films are used in commercially available susceptors, for example, the QWIKWAVE® Focus susceptor and the MICRORITE® susceptor, both available from Graphic Packaging International (Marietta, Ga.). Examples of polyethylene terephthalate films that may be suitable for use as the substrate include, but are not limited to, MELINEX®, commercially available from DuPont Teijan Films (Hopewell, Va.), SKYROL, commercially available from SKC, Inc. (Covington, Ga.), and BARRIALOX PET, available from Toray Films (Front Royal, Va.), and QU50 High Barrier Coated PET, available from Toray Films (Front Royal, Va.).

The polymeric film may be selected to impart various properties to the microwave interactive web, for example, printability, heat resistance, or any other property. As one particular example, the polymeric film may be selected to provide a water barrier, oxygen barrier, or a combination thereof. Such barrier film layers may be formed from a polymer film having barrier properties or from any other barrier layer or coating as desired. Suitable polymer films may include, but are not limited to, ethylene vinyl alcohol, barrier nylon, polyvinylidene chloride, barrier fluoropolymer, nylon 6, nylon 6,6, coextruded nylon 6/EVOH/nylon 6, silicon oxide coated film, barrier polyethylene terephthalate, or any combination thereof.

One example of a barrier film that may be suitable for use with the present invention is CAPRAN® EMBLEM 1200M nylon 6, commercially available from Honeywell International (Pottsville, Pa.). Another example of a barrier film that may be suitable is CAPRAN® OXYSHIELD OBS monoaxially oriented coextruded nylon 6/ethylene vinyl alcohol (EVOH)/nylon 6, also commercially available from Honeywell International. Yet another example of a barrier film that may be suitable for use with the present invention is DARTEK® N-201 nylon 6,6, commercially available from Enhance Packaging Technologies (Webster, N.Y.). Additional examples include BARRIALOX PET, available from Toray Films (Front Royal, Va.) and QU50 High Barrier Coated PET, available from Toray Films (Front Royal, Va.), referred to above.

Still other barrier films include silicon oxide coated films, such as those available from Sheldahl Films (Northfield, Minn.). Thus, in one example, a susceptor may have a structure including a film, for example, polyethylene terephthalate, with a layer of silicon oxide coated onto the film, and ITO or other material deposited over the silicon oxide. If needed or desired, additional layers or coatings may be provided to shield the individual layers from damage during processing.

The barrier film may have an oxygen transmission rate (OTR) as measured using ASTM D3985 of less than about 20 $cc/m^2/day$. In one aspect, the barrier film has an OTR of less than about 10 $cc/m^2/day$. In another aspect, the barrier film has an OTR of less than about 1 $cc/m^2/day$. In still another aspect, the barrier film has an OTR of less than about 0.5 $cc/m^2/day$. In yet another aspect, the barrier film has an OTR of less than about 0.1 $cc/m^2/day$.

The barrier film may have a water vapor transmission rate (WVTR) of less than about 100 $g/m^2/day$ as measured using ASTM F1249. In one aspect, the barrier film has a WVTR of less than about 50 $g/m^2/day$. In another aspect, the barrier film has a WVTR of less than about 15 $g/m^2/day$. In yet another aspect, the barrier film has a WVTR of less than about 1 $g/m^2day$. In still another aspect, the barrier film has a WVTR of less than about 0.1 $g/m^2/day$. In a still further aspect, the barrier film has a WVTR of less than about 0.05 $g/m^2/day$.

The microwave energy interactive material may be applied to the substrate in any suitable manner, and in some instances, the microwave energy interactive material is printed on, extruded onto, sputtered onto, evaporated on, or laminated to the substrate. The microwave energy interactive material may be applied to the substrate in any pattern, and using any technique, to achieve the desired heating effect of the food item.

For example, the microwave energy interactive material may be provided as a continuous or discontinuous layer or coating including circles, loops, hexagons, islands, squares, rectangles, octagons, and so forth. Examples of various patterns and methods that may be suitable for use with the present invention are provided in U.S. Pat. Nos. 6,765,182; 6,717,121; 6,677,563; 6,552,315; 6,455,827; 6,433,322; 6,414,290; 6,251,451; 6,204,492; 6,150,646; 6,114,679; 5,800,724; 5,759,422; 5,672,407; 5,628,921; 5,519,195; 5,424,517; 5,410,135; 5,354,973; 5,340,436; 5,266,386; 5,260,537; 5,221,419; 5,213,902; 5,117,078; 5,039,364; 4,963,424; 4,936,935; 4,890,439; 4,775,771; 4,865,921; and U.S. Re. Pat. No. 34,683, each of which is incorporated by reference herein in its entirety. Although particular examples of patterns of microwave energy interactive material are shown and described herein, it should be understood that other patterns of microwave energy interactive material are contemplated by the present invention.

B. Microwave Transparent Support

According to various aspects of the present invention, the microwave interactive element or microwave interactive web may be joined to or overlie a dimensionally stable, microwave energy transparent support (hereinafter referred to as "microwave transparent support", "microwave inactive support" or "support") to form the construct.

In one aspect, all or a portion of the support may be formed at least partially from a paperboard material, which may be cut into a blank prior to use in the construct. For example, the support may be formed from paperboard having a basis weight of from about 60 to about 330 lbs/ream, for example, from about 80 to about 140 lbs/ream. The paperboard generally may have a thickness of from about 6 to about 30 mils, for example, from about 12 to about 28 mils. In one particular example, the paperboard has a thickness of about 12 mils. Any suitable paperboard may be used, for example, a solid bleached or solid unbleached sulfate board, such as SUS® board, commercially available from Graphic Packaging International.

Alternatively, all or a portion of the support may be formed at least partially from a polymeric material, for example, coextruded polyethylene terephthalate or polypropylene. Other materials are contemplated hereby.

Optionally, one or more portions of the various blanks, supports, packages, or other constructs described herein or contemplated hereby may be coated with varnish, clay, or other materials, either alone or in combination. The coating may then be printed over with product advertising or other information or images. The blanks, supports, packages, or other constructs also may be coated to protect any information printed thereon.

Furthermore, the blanks, supports, packages, or other constructs may be coated with, for example, a moisture and/or oxygen barrier layer, on either or both sides, such as those described above. Any suitable moisture and/or oxygen barrier material may be used in accordance with the present invention. Examples of materials that may be suitable include, but are not limited to, polyvinylidene chloride, ethylene vinyl alcohol, DuPont DARTEK™ nylon 6,6, and others referred to above.

Alternatively or additionally, any of the blanks, supports, packages, or other constructs of the present invention may be coated or laminated with other materials to impart other properties, such as absorbency, repellency, opacity, color, printability, stiffness, or cushioning. For example, absorbent susceptors are described in U.S. Provisional Application No. 60/604,637, filed Aug. 25, 2004, and U.S. patent application Ser. No. 11/211,858, to Middleton, et al., titled "Absorbent Microwave Interactive Packaging", filed Aug. 25, 2005, both of which are incorporated herein by reference in their entirety. Additionally, the blanks, supports, packages, or other constructs may include graphics or indicia printed thereon.

It will be understood that with some combinations of elements and materials, the microwave interactive element may have a grey or silver color this is visually distinguishable from the substrate or the support. However, in some instances, it may be desirable to provide a web or construct having a uniform color and/or appearance. Such a web or construct may be more aesthetically pleasing to a consumer, particularly when the consumer is accustomed to packages or containers having certain visual attributes, for example, a solid color, a particular pattern, and so on. Thus, for example, the present invention contemplates using a silver or grey toned adhesive to join the microwave interactive elements to the substrate, using a silver or grey toned substrate to mask the presence of the silver or grey toned microwave interactive element, using a dark toned substrate, for example, a black toned substrate, to conceal the presence of the silver or grey toned microwave interactive element, overprinting the metallized side of the web with a silver or grey toned ink to obscure the color variation, printing the non-metallized side of the web with a silver or grey ink or other concealing color in a suitable pattern or as a solid color layer to mask or conceal the presence of the microwave interactive element, or any other suitable technique or combination thereof.

If desired, a combination of paper layers, polymer film layers, and microwave interactive elements may be used to form a microwave energy interactive insulating material. As used herein, the term "microwave energy interactive insulating material" or "microwave interactive insulating material" or "insulating material" refers any combination of layers of materials that is both responsive to microwave energy and capable of providing some degree of thermal insulation when used to heat a food item. An insulating material may be used to form all or a portion of a construct used in accordance with the present invention. For example, an insulating material may be used to form all or a portion of a wrapper or pouch according to the invention.

The insulating material may include various components, provided that each is resistant to softening, scorching, combusting, or degrading at typical microwave oven heating temperatures, for example, at from about 250° F. to about 425° F. The insulating material may include both microwave energy responsive or interactive components, and microwave energy transparent or inactive components.

In one aspect, the insulating material comprises one or more susceptor layers in combination with one or more expandable insulating cells. Additionally, the insulating material may include one or more microwave energy transparent or inactive materials to provide dimensional stability, to improve ease of handling the microwave energy interactive material, and/or to prevent contact between the microwave energy interactive material and the food item. For example, an insulating material may comprise a microwave energy interactive material supported on a first polymeric film layer, a moisture-containing layer superposed with the microwave energy interactive material and a second polymeric film layer joined to the moisture-containing layer in a predetermined pattern, thereby forming one or more closed cells between the moisture-containing layer and the second polymeric film layer. The closed cells expand or inflate in response to being exposed to microwave energy, and thereby causing microwave energy interactive material to bulge and deform.

Several exemplary insulating materials are depicted in FIGS. 1A-4C. In each of the examples shown herein, it should be understood that the layer widths are not necessarily shown in perspective. In some instances, for example, the adhesive layers may be very thin with respect to other layers, but are nonetheless shown with some thickness for purposes of clearly illustrating the arrangement of layers.

Figure 1B:
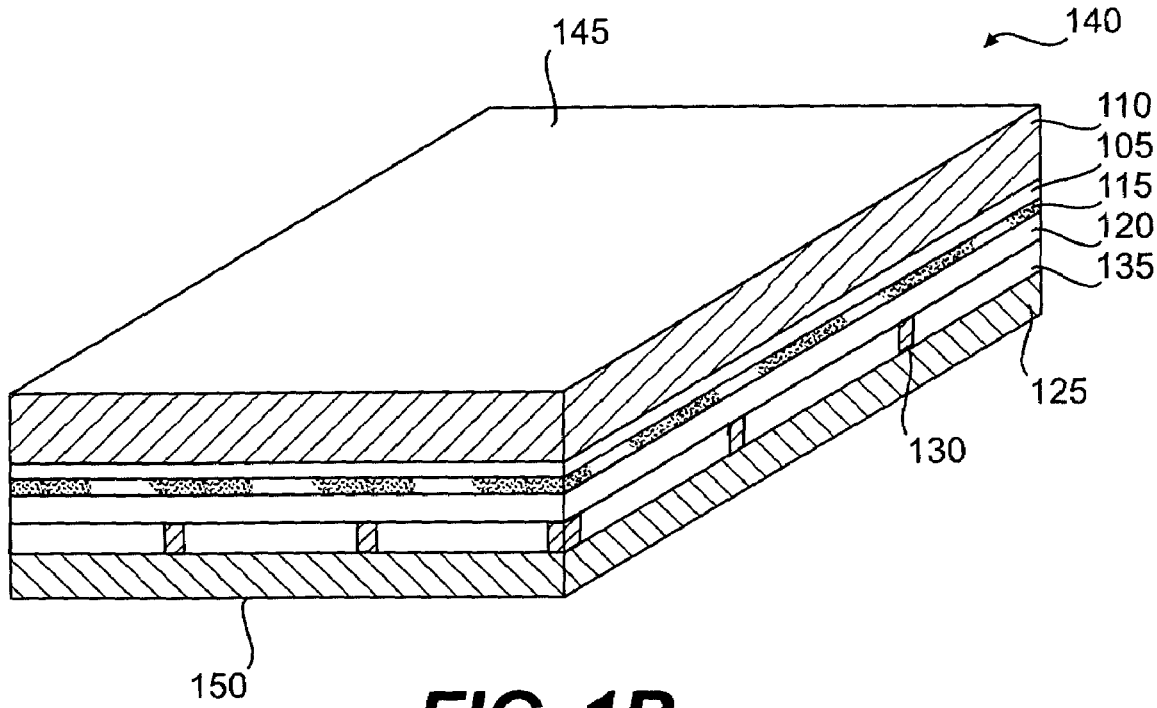
FIG. 1B depicts the exemplary microwave energy interactive insulating material of FIG. 1A, in the form of a cut sheet.

FIG. 1A depicts an exemplary insulating material 100 that may be used with various aspects of the invention. In this example, a thin layer of microwave energy interactive material 105 is supported on a first polymeric film 110 and bonded by lamination with an adhesive 115 (or otherwise) to a dimensionally stable substrate 120, for example, paper. The substrate 120 is bonded to a second plastic film 125 using a patterned adhesive 130 or other material, such that closed cells 135 are formed in the material 100. The insulating material 100 may be cut and provided as a substantially flat, multi-layered sheet 140, as shown in FIG. 1B.

Figure 1C:
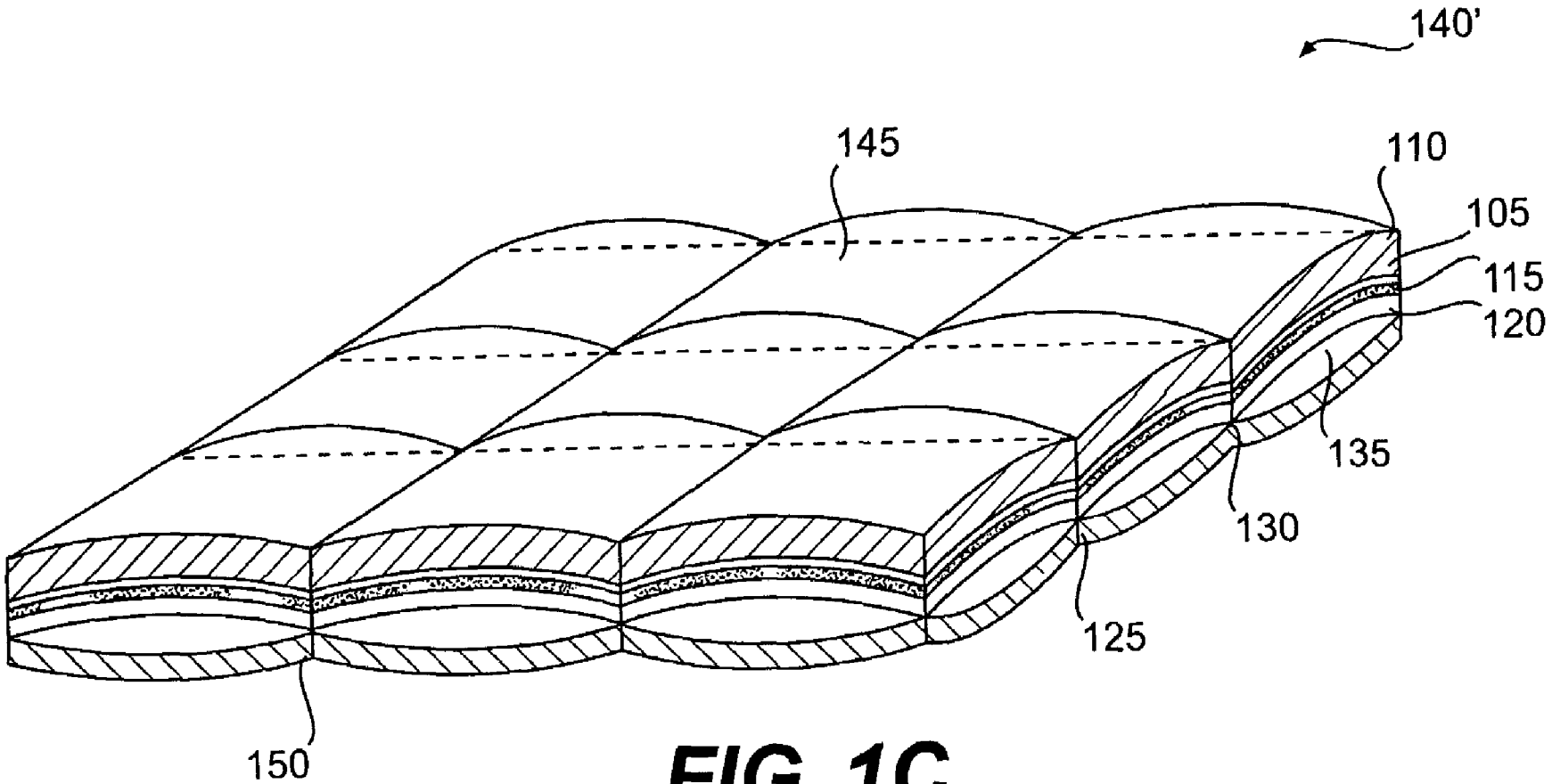
FIG. 1C depicts the exemplary microwave energy interactive insulating sheet of FIG. 1B, upon exposure to microwave energy.

As the microwave energy interactive material 105 heats upon impingement by microwave energy, water vapor and other gases typically held in the substrate 120, for example, paper, and any air trapped in the thin space between the second plastic film 125 and the substrate 120 in the closed cells 135, expand, as shown in FIG. 1C. The resulting insulating material 140' has a quilted or pillowed top surface 145 and bottom surface 150. When microwave heating has ceased, the cells 135 typically deflate and return to a somewhat flattened state.

Figure 2:
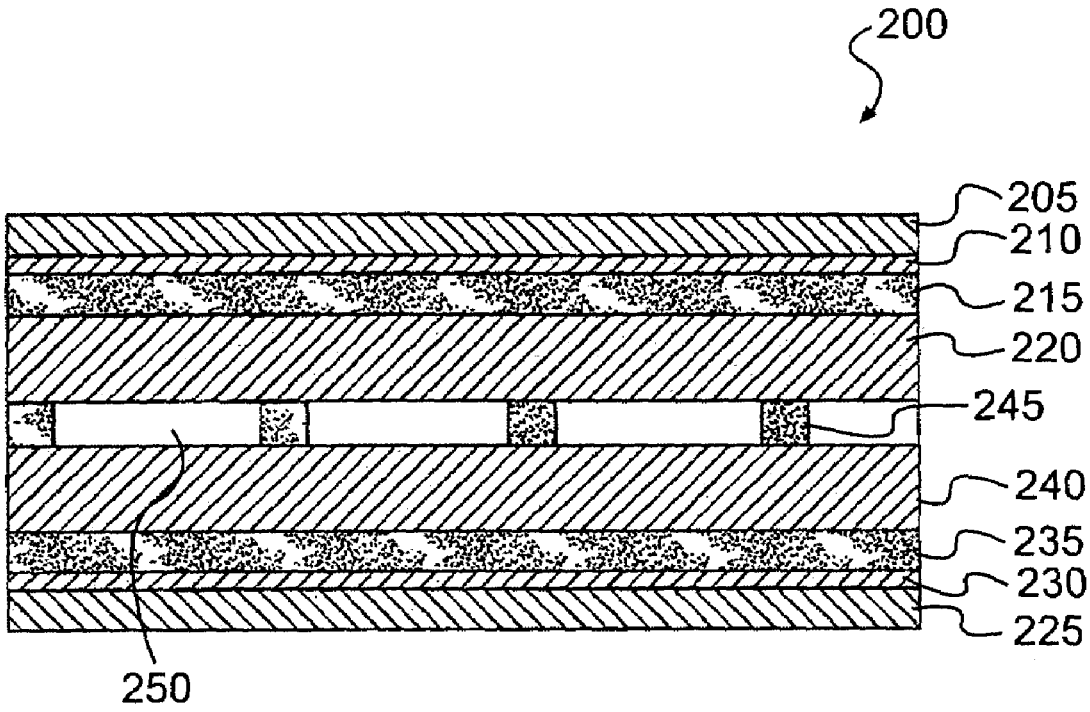
FIG. 2 depicts a schematic cross-sectional view of another exemplary microwave energy interactive insulating material that may be used to form a package in accordance with various aspects of the present invention.
Figure 3:
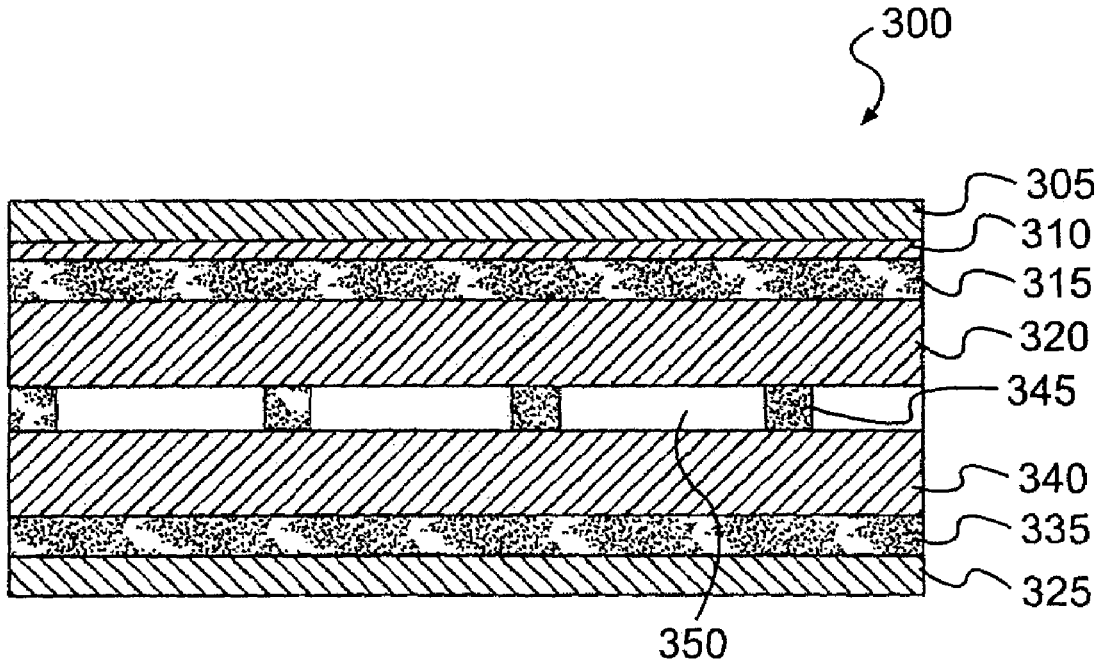
FIG. 3 depicts a schematic cross-sectional view of yet another exemplary microwave energy interactive insulating material that may be used to form a package in accordance with various aspects of the present invention.

FIGS. 2 and 3 depict other exemplary insulating materials according to various aspects of the present invention. Referring first to FIG. 2, an insulating material 200 is shown with two symmetrical layer arrangements adhered together by a patterned adhesive layer. The first symmetrical layer arrangement, beginning at the top of the drawings, comprises a PET film layer 205, a metal layer 210, an adhesive layer 215, and a paper or paperboard layer 220. The metal layer 210 may comprise a metal, such as aluminum, deposited along at least a portion of the PET film layer 205. The PET film 205 and metal layer 210 together define a susceptor. The adhesive layer 215 bonds the PET film 205 and the metal layer 210 to the paperboard layer 220.

The second symmetrical layer arrangement, beginning at the bottom of the drawings, also comprises a PET film layer 225, a metal layer 230, an adhesive layer 235, and a paper or paperboard layer 240. If desired, the two symmetrical arrangements may be formed by folding one layer arrangement onto itself. The layers of the second symmetrical layer arrangement are bonded together in a similar manner as the layers of the first symmetrical arrangement. A patterned adhesive layer 245 is provided between the two paper layers 220 and 240, and defines a pattern of closed cells 250 configured to expand when exposed to microwave energy. By using an insulating material 200 having two metal layers 210 and 230, more heat is generated, thereby achieving greater cell loft. As a result, such a material is able to elevate a food item seated thereon to a greater extent than an insulating material having a single microwave energy interactive material layer.

Referring to FIG. 3, yet another insulating material 300 is shown. The material 300 includes a PET film layer 305, a metal layer 310, an adhesive layer 315, and a paper layer 320. Additionally, the material 300 may include a clear PET film layer 325, an adhesive 335, and a paper layer 340. The layers are adhered or affixed by a patterned adhesive 345 defining a plurality of closed expandable cells 350.

Figure 4A:
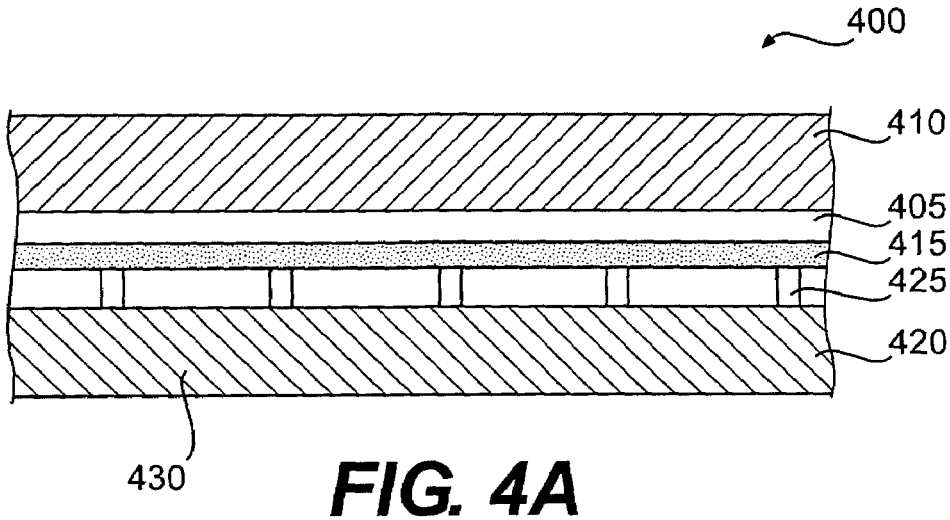
FIG. 4A depicts a schematic cross-sectional view of still another exemplary microwave energy interactive insulating material that may be used to form a package in accordance with various aspects of the present invention.
Figure 4B:
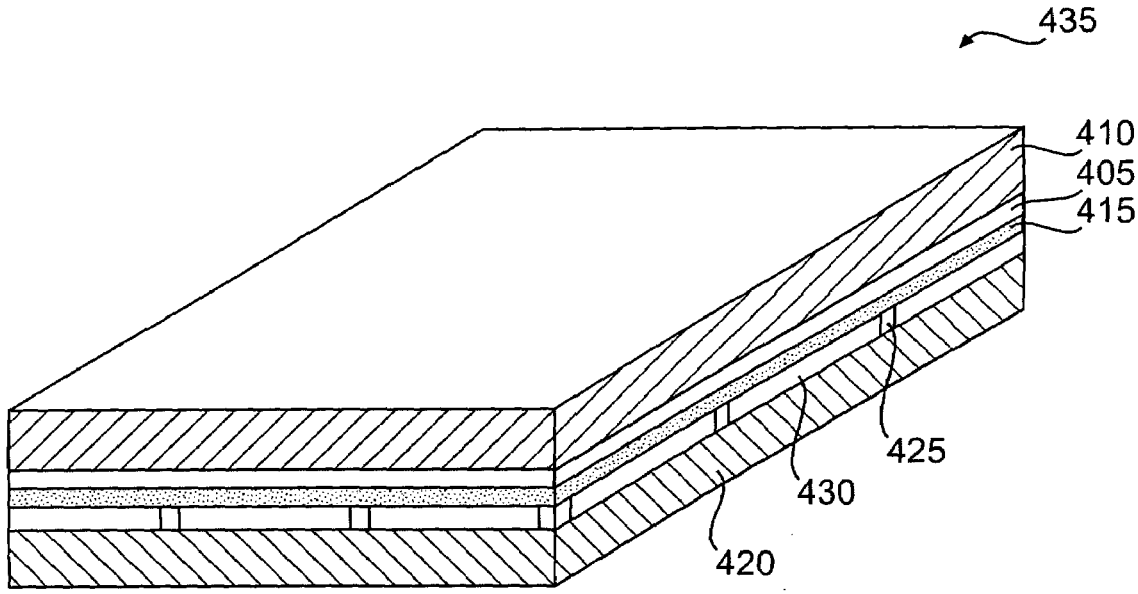
FIG. 4B depicts the exemplary microwave energy interactive insulating material of FIG. 4A, in the form of a cut sheet.
Figure 4C:
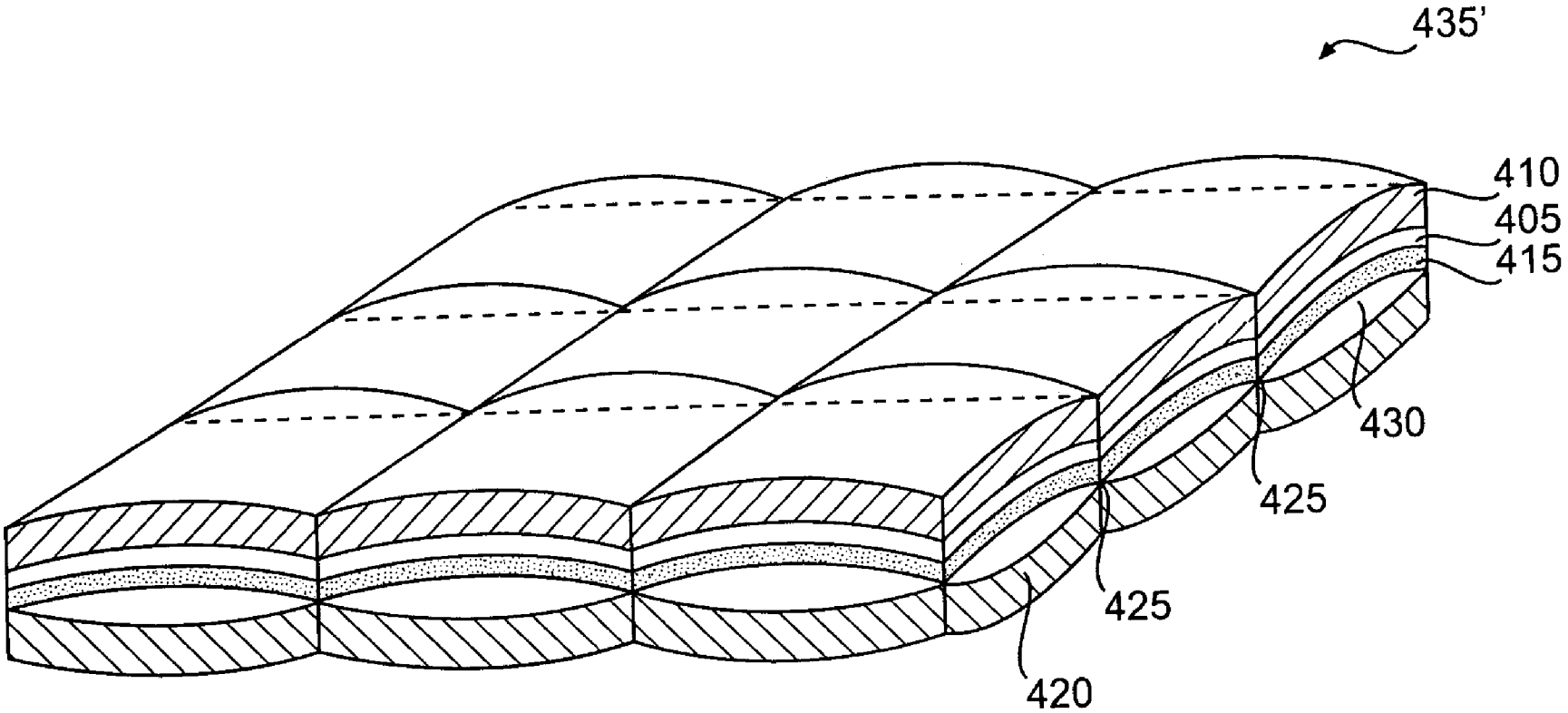
FIG. 4C depicts the exemplary microwave energy interactive insulating sheet of FIG. 4B, upon exposure to microwave energy.

Turning now to FIGS. 4A-4C, another exemplary insulating material 400 is depicted. In this example, one or more reagents are used to generate a gas that expands the cells of the insulating material. In this example, one or more reagents are used to generate a gas that expands the cells of the insulating material. For example, the reagents may comprise sodium bicarbonate ($NaHCO_3$) and a suitable acid. When exposed to heat, the reagents react to produce carbon dioxide. As another example, the reagent may comprise a blowing agent. Examples of blowing agents that may be suitable include, but are not limited to, p-p'-oxybis(benzenesulphonylhydrazide), azodicarbonamide, and p-toluenesulfonylsemicarbazide. However, it will be understood that numerous other reagents and released gases are contemplated hereby.

In the example shown in FIG. 4A, a thin layer of microwave interactive material 405 is supported on a first plastic film 410 to form a susceptor film. One or more reagents 415, optionally within a coating, overlie at least a portion of the layer of microwave interactive material 405. The reagent 415 is joined to a second plastic film 420 using a patterned adhesive 425 or other material, or using thermal bonding, ultrasonic bonding, or any other suitable technique, such that closed cells 430 (shown as a void) are formed in the material 400. The insulating material 400 may be cut into a sheet 435, as shown in FIG. 4B.

FIG. 4C depicts the exemplary insulating material 435 of FIG. 4B after being exposed to microwave energy from a microwave oven (not shown). As the microwave interactive material 405 heats upon impingement by microwave energy, water vapor or other gases are released from or generated by the reagent 415. The resulting gas applies pressure on the susceptor film 410 on one side and the second plastic film 420 on the other side of the closed cells 430. Each side of the material 400 forming the closed cells 430 reacts simultaneously, but uniquely, to the heating and vapor expansion to form a quilted insulating material 435'. This expansion may occur within 1 to 15 seconds in an energized microwave oven, and in some instances, may occur within 2 to 10 seconds. Even without a paper or paperboard layer, the water vapor resulting from the reagent is sufficient both to inflate the expandable cells and to absorb any excess heat from the microwave energy interactive material.

Typically, when microwave heating has ceased, the cells or quilts may deflate and return to a somewhat flattened state. Alternatively, the insulating material may comprise a durably expandable microwave energy interactive insulating material. As used herein, the term "durably expandable microwave energy interactive insulating material" or "durably expandable insulating material" refers to an insulating material that includes expandable cells that tend to remain at least partially, substantially, or completely inflated after exposure to microwave energy has been terminated. Such materials may be used to form multi-functional packages and other constructs that can be used to heat a food item, to provide a surface for safe and comfortable handling of the food item, and to contain the food item after heating. Thus, a durably expandable insulating material may be used to form a package or construct that facilitates storage, preparation, transportation, and consumption of a food item, even "on the go".

In one aspect, a substantial portion of the plurality of cells remain substantially expanded for at least about 1 minute after exposure to microwave energy has ceased. In another aspect, a substantial portion of the plurality of cells remain substantially expanded for at least about 5 minutes after exposure to microwave energy has ceased. In still another aspect, a substantial portion of the plurality of cells remain substantially expanded for at least about 10 minutes after exposure to microwave energy has ceased. In yet another aspect, a substantial portion of the plurality of cells remain substantially expanded for at least about 30 minutes after exposure to microwave energy has ceased. It will be understood that not all of the expandable cells in a particular construct or package must remain inflated for the insulating material to be considered to be "durable". Instead, only a sufficient number of cells must remain inflated to achieve the desired objective of the package or construct in which the material is used.

For example, where a durably expandable insulating material is used to form all or a portion of a package or construct for storing a food item, heating, browning, and/or crisping the food item in a microwave oven, removing it from the microwave oven, and removing it from the construct, only a sufficient number of cells need to remain at least partially inflated for the time required to heat, brown, and/or crisp the food item and remove it from the microwave oven after heating. In contrast, where a durably expandable insulating material is used to form all or a portion of a package or construct for storing a food item, heating, browning, and/or crisping the food item in a microwave oven, removing the food item from the microwave oven, and consuming the food item within the construct, a sufficient number of cells need to remain at least partially inflated for the time required to heat, brown, and/or crisp the food item, remove it from the microwave oven after heating, and transport the food item until the food item and/or construct has cooled to a surface temperature comfortable for contact with the hands of the user.

Any of the durably expandable insulating materials of the present invention may be formed at least partially from one or more barrier materials, for example, polymeric films, that substantially reduce or prevent the transmission of oxygen, water vapor, or other gases from the expanded cells. Examples of such materials are described above. However, the use of other materials is contemplated hereby.

It will be understood that the various insulating materials of the present invention enhance heating, browning, and crisping of a food item in a microwave oven. First, the water vapor, air, and other gases contained in the closed cells provide insulation between the food item and the ambient environment of the microwave oven, thereby increasing the amount of sensible heat that stays within or is transferred to the food item. Additionally, the formation of the cells allows the material to conform more closely to the surface of the food item, placing the susceptor film in greater proximity to the food item, thereby enhancing browning and/or crisping. Furthermore, insulating materials may help to retain moisture in the food item when cooking in the microwave oven, thereby improving the texture and flavor of the food item. Additional benefits and aspects of such materials are described in PCT Application No. PCT/US03/03779, U.S. application Ser. No. 10/501,003, and U.S. application Ser. No. 11/314,851, each of which is incorporated by reference herein in its entirety.

Any of the insulating materials described herein or contemplated hereby may include an adhesive pattern or thermal bond pattern that is selected to enhance cooking of a particular food item. For example, where the food item is a larger item, the adhesive pattern may be selected to form substantially uniformly shaped expandable cells. Where the food item is a small item, the adhesive pattern may be selected to form a plurality of different sized cells to allow the individual items to be variably contacted on their various surfaces. While several examples are provided herein, it will be understood that numerous other patterns are contemplated hereby, and the pattern selected will depend on the heating, browning, crisping, and insulating needs of the particular food item.

If desired, multiple layers of insulating materials may be used to enhance the insulating properties of the insulating material and, therefore, enhance the browning and crisping of the food item. Where multiple layers are used, the layers may remain separate or may be joined using any suitable process or technique, for example, thermal bonding, adhesive bonding, ultrasonic bonding or welding, mechanical fastening, or any combination thereof. In one example, two sheets of an insulating material may be arranged so that their respective susceptor film layers are facing away from each other. In another example, two sheets of an insulating material may be arranged so that their respective susceptor film layers are facing towards each other. In still another example, multiple sheets of an insulating material may be arranged in a like manner and superposed. In a still further example, multiple sheets of various insulating materials are superposed in any other configuration as needed or desired for a particular application.

II. Example Constructs

Numerous constructs and systems are contemplated by the present invention. The constructs may include trays, sleeves, cartons, pouches, wraps, or any other container or package. The various constructs may be formed from any suitable material or combination of materials or components, including both microwave energy interactive components and microwave energy inactive or transparent components, such as those described herein or contemplated hereby.

The various constructs and systems may have any shape, for example, triangular, square, rectangular, circular, oval, pentagonal, hexagonal, octagonal, or any other shape. However, it should be understood that other shapes and configurations are contemplated by the present invention. The shape of the construct may be determined by the shape and portion size of the food item or items being heated, and it should be understood that different packages are contemplated for different food items and combinations of food items, for example, dough-based food items, breaded food items, sandwiches, pizzas, French fries, soft pretzels, chicken nuggets or strips, fried chicken, pizza bites, cheese sticks, pastries, doughs, egg rolls, soups, dipping sauces, gravy, vegetables, and so forth.

In one aspect, the various systems of the invention may include a paperboard carton having a top, bottom, and a plurality of sides. The carton may include any of numerous features, including multiple compartments for separating food items therein, one or more microwave energy interactive materials, or other feature needed or desired to achieve the desired heating, browning, and/or crisping result. In another aspect, the various systems may include a single or multi-compartment pressed paper tray or molded polymeric tray with a polymer film cover or overwrap. The overwrap may be one that is intended to be pierced or removed partially or completely prior to heating in a microwave oven. In still another aspect, the system may include a single or multi-compartment tray and a paper, paperboard, polymer film, or plastic sleeve that at least partially receives the tray. The sleeve may be rigid, semi-rigid, or flexible, and may include one or more microwave energy interactive materials on an interior or exterior surface thereof aligned with the various food items to achieve the desired heating effect.

Various aspects of the invention may be illustrated by referring to the figures. For purposes of simplicity, like numerals may be used to describe like features. It will be understood that where a plurality of similar features are depicted, not all of such features necessarily are labeled on each figure. Although several different exemplary aspects, implementations, and embodiments of the various inventions are provided, numerous interrelationships between, combinations thereof, and modifications of the various inventions, aspects, implementations, and embodiments of the inventions are contemplated hereby.

Figure 5A:
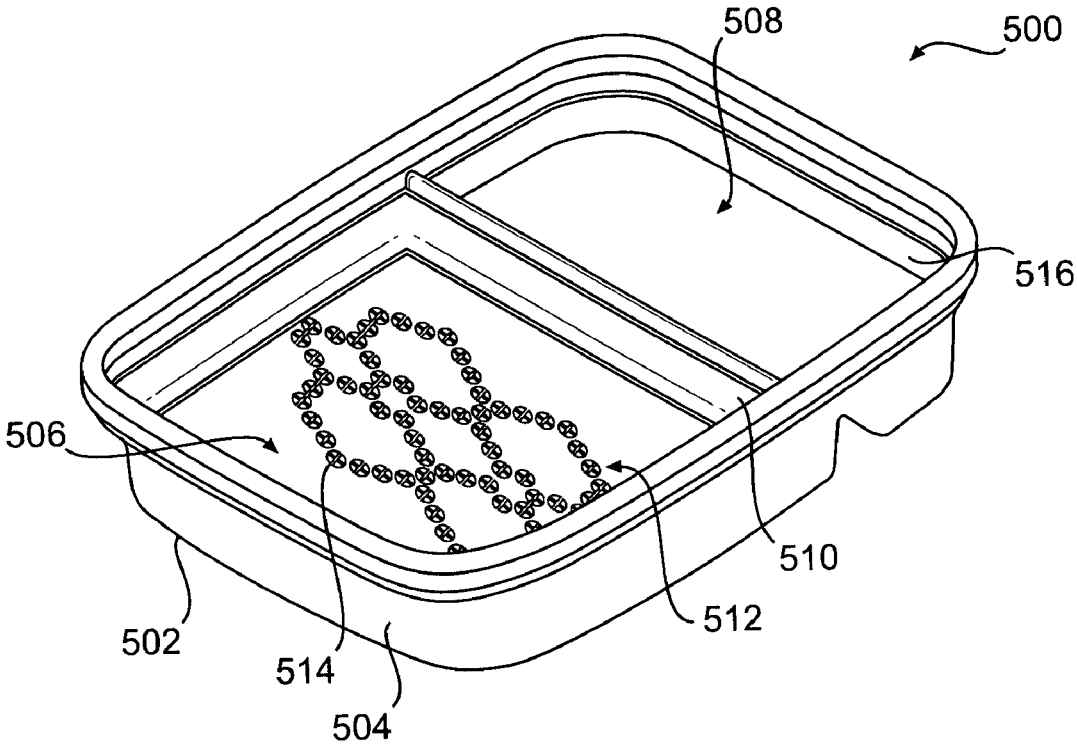
FIG. 5A depicts an exemplary construct according to various aspects of the present invention.
Figure 5B:
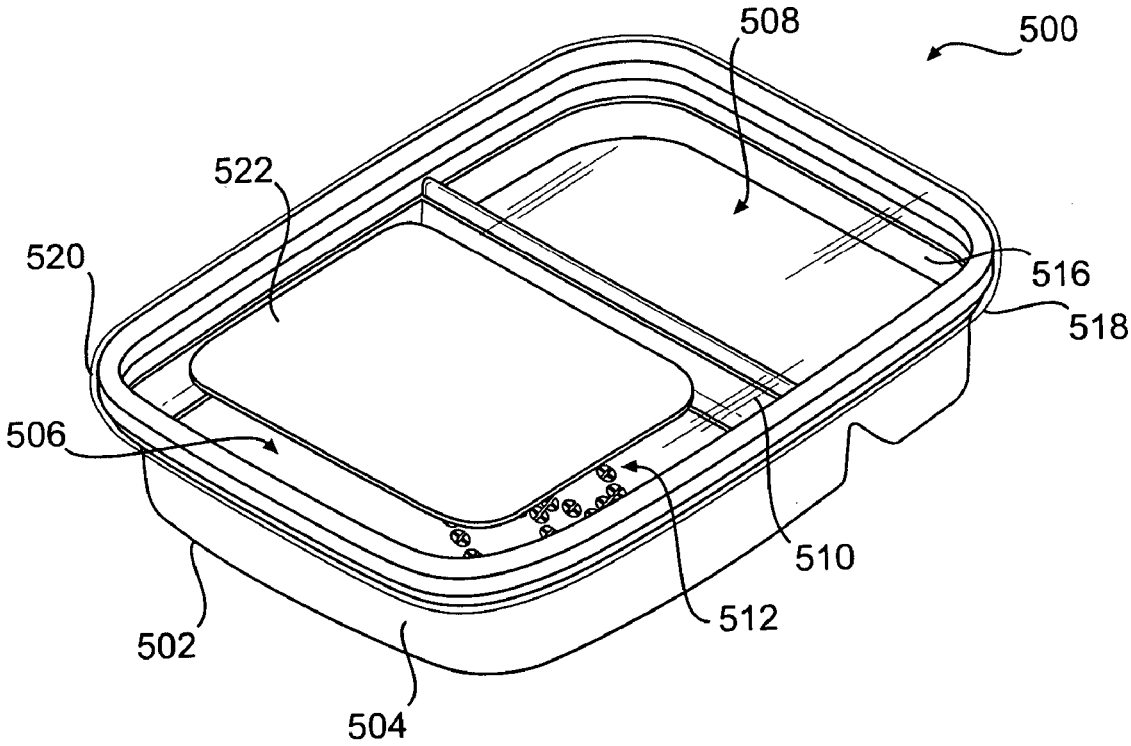
FIG. 5B depicts another exemplary construct according to various aspects of the present invention, which is a variation of the construct of FIG. 5A.

FIGS. 5A and 5B illustrate an exemplary construct according to various aspects of the invention. In this example, the construct is in the form of a carton or pressed tray 500 including a base 502 and at least one upstanding wall 504 at least partially defining a plurality of compartments including a first compartment 506 and a second compartment 508.

The first compartment 506 includes at least one microwave energy interactive element and, in this example, includes both a microwave energy shielding element 510, and a microwave energy directing element 512. The shielding element 510, in this example, a metal foil, overlies at least a portion of the upstanding walls 504 that define the first compartment 506. The directing element 512, a segmented metal foil configured as a plurality of loops 514 or rings, overlies at least a portion of the base 502 within the first compartment 506. Likewise, the second compartment 508 includes at least one microwave energy interactive element, in this example, a susceptor 516 that overlies at least a portion of the upstanding walls 504 that define the second compartment 508.

In this and other aspects of the invention, the various microwave energy interactive elements are selected so that a plurality of food items (not shown) seated in the first compartment 506 and the second compartment 508 are heated to their respective desired serving temperatures in substantially the same amount of time. Thus, it will be understood that the particular microwave energy interactive elements selected will vary depending on the particular food items to be heated, and that any of the numerous microwave energy interactive elements described herein or contemplated hereby may be used in any combination, arrangement, or configuration as needed or desired for a particular application.

In this example, it has been found that where the first compartment 506 is used to heat a frozen dough-based food item, for example, a sandwich, and the second compartment 508 is used to heat a frozen liquid or semi-liquid food item, for example, a soup, both items can be heated evenly and properly in about the same amount of time. Notably, it has been discovered that use of a susceptor 516 to heat the liquid or semi-liquid food item decreases the overall heating time of the food item, as compared with a compartment or container without a susceptor 516 (see Examples).

If desired, in this and other aspects of the invention, a partial or complete overwrap 518 may overlie all or a portion of the tray 500, as shown in FIG. 5B. The overwrap may be formed at least partially from or may include a microwave energy interactive element to enhance heating, browning, and/or crisping of one or more of the various food items being heated. In this example, the overwrap comprises a transparent polymeric film 520. However, other materials may be used in accordance with the invention. A microwave energy interactive material in the form of a foil shielding element 522 is supported on a portion of the film 520 overlying the first compartment 506. However, other elements and configurations are contemplated hereby.

Figure 6A:
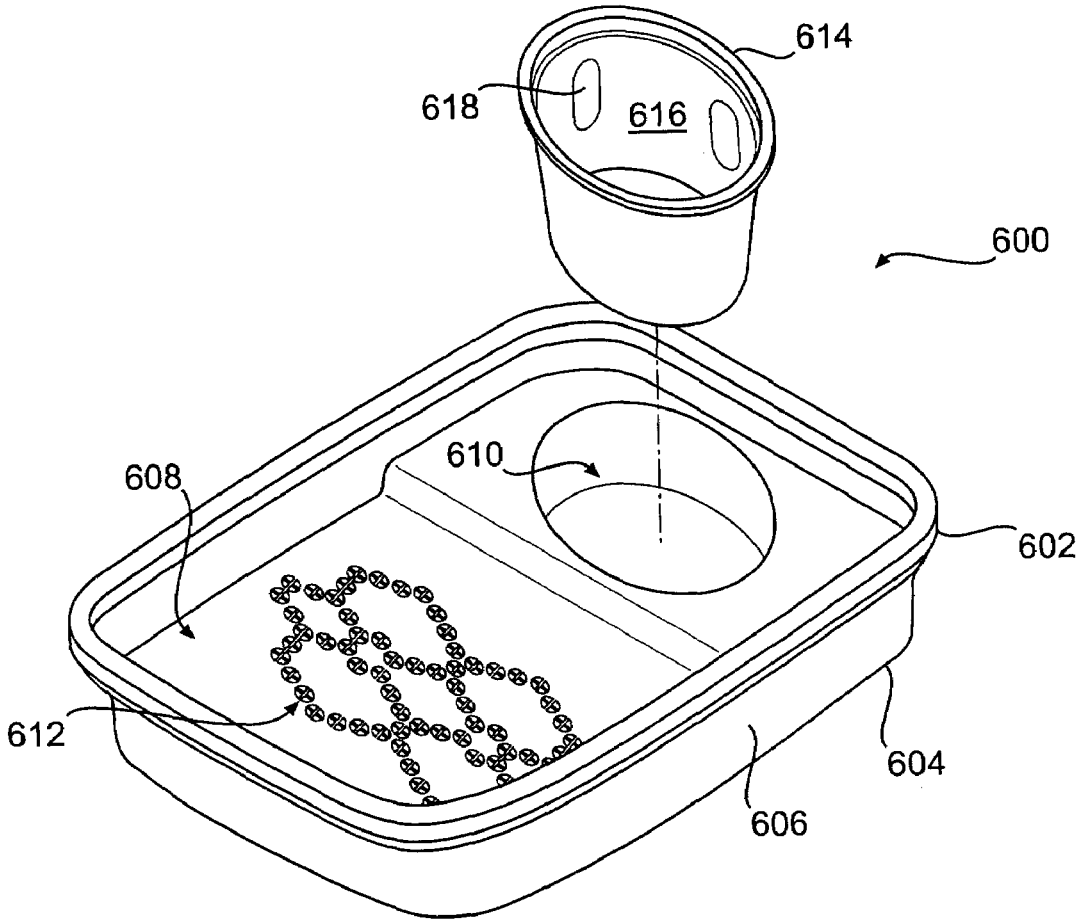
FIG. 6A depicts yet another exemplary construct according to various aspects of the present invention.
Figure 6B:
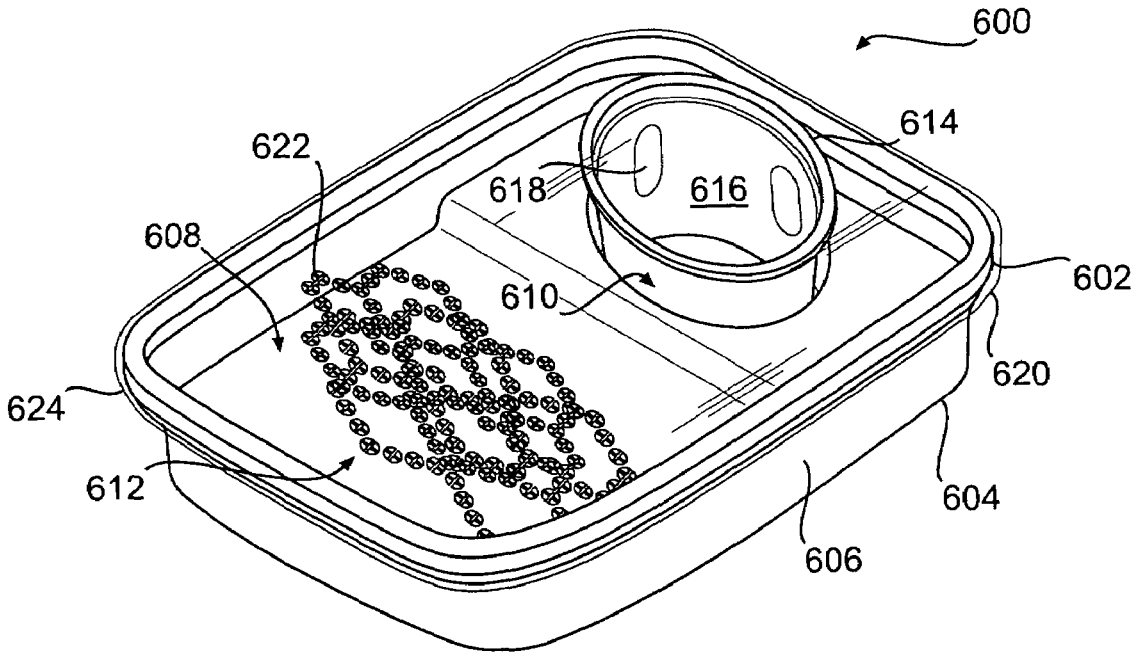
FIG. 6B depicts still another exemplary construct according to various aspects of the present invention, which is a variation of the construct of FIG. 6A.

Turning now to FIGS. 6A and 6B, an exemplary system 600 for heating a plurality of food items is illustrated. In this example, the system 600 comprises a tray 602 including a base 604 and at least one upstanding wall 606 that at least partially defines at least a first compartment 608 and a second compartment 610. A first microwave energy interactive element, in this example, a segmented metal foil 612, at least partially overlies and may be at least partially joined to the first compartment 608 of the tray 602. The system 600 also includes a container 614 dimensioned to be seated removably within the second compartment 610 of the tray 602. The container 614 may include a second microwave energy interactive element, for example, an apertured susceptor 616, a susceptor, a segmented metal foil overlying a susceptor, or any other element as desired. In this example, the plurality of apertures 618 comprise deactivated metal having a somewhat obround shape. As used herein, the term "obround" refers to a shape consisting of two semicircles connected by parallel lines tangent to their endpoints. However, other shapes of physical and non-physical apertures are contemplated hereby.

As shown in FIG. 6B, a partial or complete overwrap 620 may overlie all or a portion of the tray 602 prior to and/or during heating. In this example, the overwrap 620 overlies the top of the first compartment 608 and the second compartment 610 of the tray 602. The overwrap 620 comprises a microwave energy interactive material, in this example, configured as a plurality of segmented foil loops 622, supported on and at least partially overlying a polymeric film 624. In this example, the plurality of segmented foil loops 622 overlie only the first compartment 608. However, other configurations are contemplated hereby.

Figure 7:
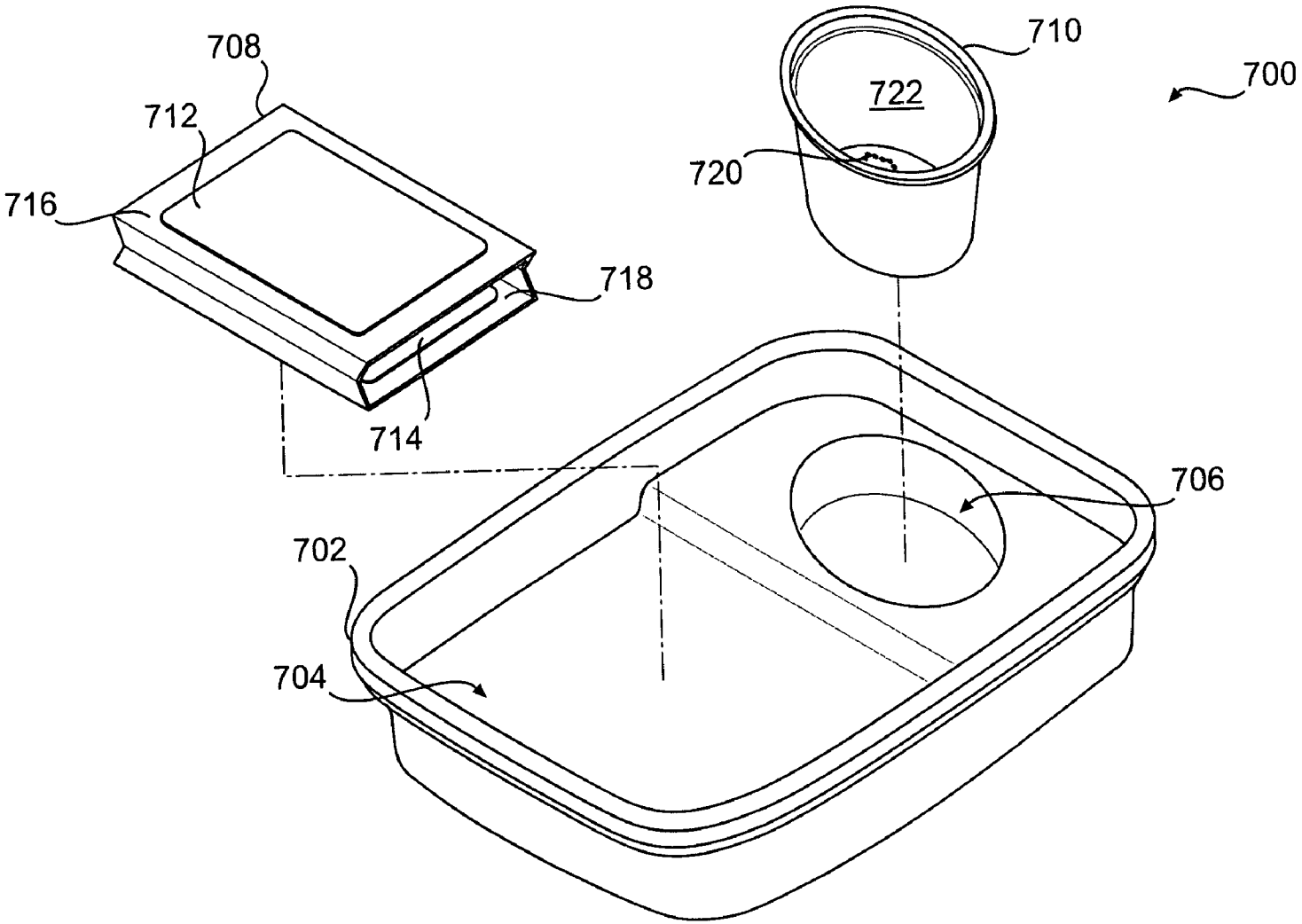
FIG. 7 depicts yet another exemplary construct according to various aspects of the present invention.

Still another exemplary system 700 is illustrated in FIG. 7. In this example, the system 700 includes a tray 702 having a plurality of compartments including at least a first compartment 704 and a second compartment 706, a first container 708 dimensioned to be received removably within the first compartment 704, and a second container 710 dimensioned to be received within the second compartment 706.

In this example, the first container 708 comprises a flexible or semi-rigid sleeve capable of receiving a food item (not shown) therein. The sleeve 708 includes at least one microwave energy interactive element, in this example, a pair of shielding elements 712 and 714, overlying respective opposed panels or faces 716 and 718 of the sleeve 708. However, it will be understood that numerous other systems and constructs are contemplated hereby. For example, one face of the sleeve may include a shielding element, and the base of the first compartment may include another shielding element, microwave energy directing element, susceptor element, or any other suitable element or combination of elements. The second container 708, in this example, a semi-rigid or rigid cup, also includes at least one microwave energy interactive element, for example, a segmented metal foil 720 at least partially overlying a susceptor 722. However, other microwave elements may be used if desired.

In one aspect, the first container 708 may be configured to receive a first frozen food item having. a surface that desirably is browned and/or crisped when thawed, for example, a dough-based food item or a breaded food item; the second container 710 may be configured to receive a second food item that is consumed in a liquid or semi-liquid state, for example, a beverage, sauce, condiment, gravy, or soup; and the various microwave energy interactive elements may be selected such that the first food item is browned and/or crisped and the second food item is brought to a liquid or semi-liquid state in about the same amount of time when heated in a microwave oven.

Figure 8:
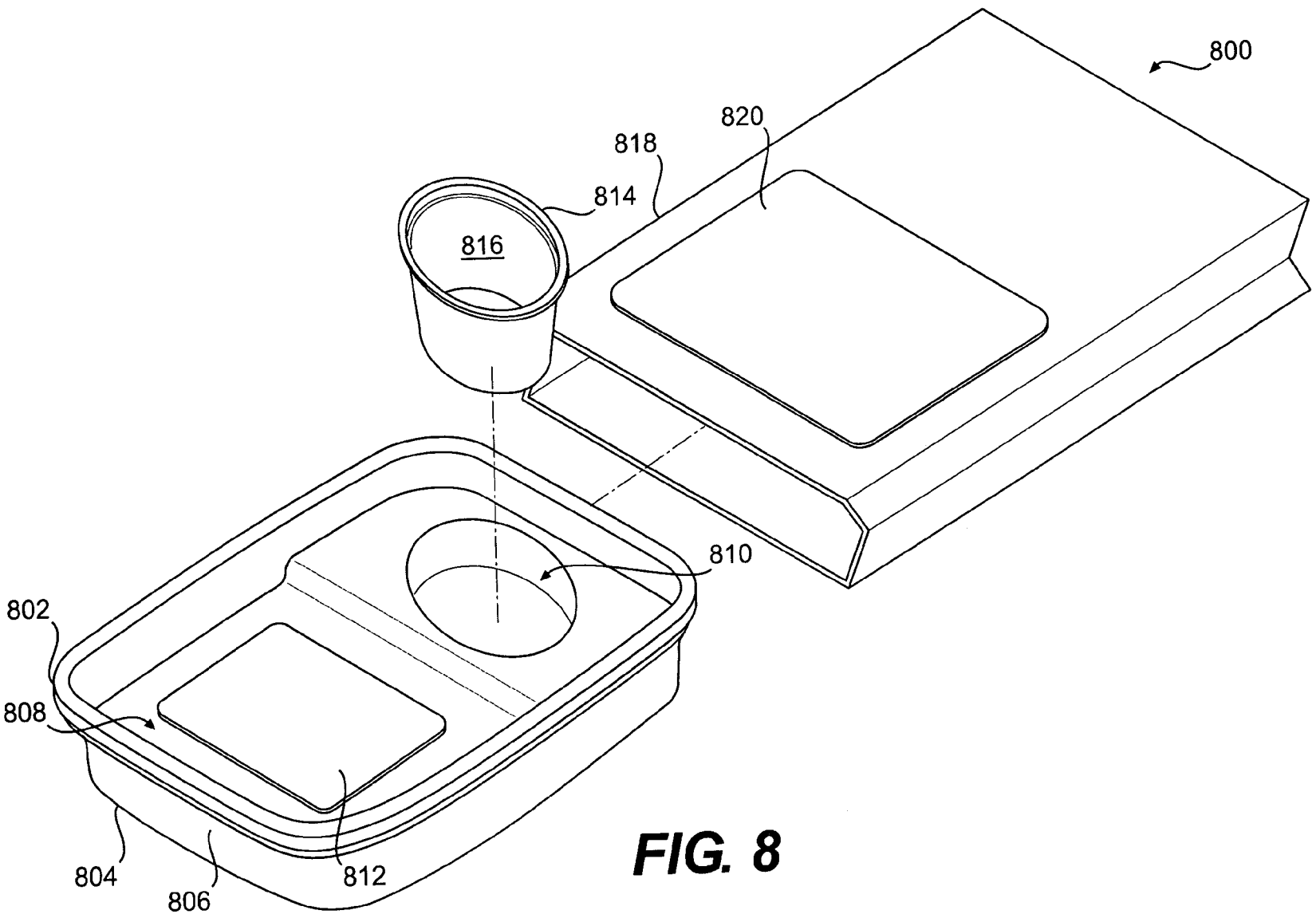
FIG. 8 depicts still another exemplary construct according to various aspects of the present invention.

Still another exemplary system 800 is provided in FIG. 8. In this example, the system 800 comprises a tray 802 including a base 804 and at least one upstanding wall 806 that defines at least a first compartment 808 and a second compartment 810. A first microwave energy interactive element, in this example, a metal foil shielding element 812, at least partially overlies and may be at least partially joined to the base 804 of the first compartment 808 of the tray 802. The system 800 also includes a container 814 dimensioned to be seated removably within the second compartment 810 of the tray 802. The container 814 may include a second microwave energy interactive element, for example, a susceptor 816, an apertured susceptor, a segmented metal foil overlying a susceptor, or any other element as desired.

The system 800 also includes a sleeve or sheath 818 dimensioned to receive the tray 802. If desired, the sleeve or sheath 818 may include one or more microwave energy interactive elements, for example, shielding element 820, to provide the desired level of heating for each food item therein. In this example, the shielding element 820 overlies only the first compartment 808. However, other configurations are contemplated hereby.

Although examples of two-compartment systems are provided herein, it will be understood that numerous other systems are contemplated hereby. For example, a tray may include a compartment for each of fried chicken, a biscuit, and gravy. The fried chicken compartment may include a susceptor material on the sides, bottom, and/or top thereof to promote browning and/or crisping of the chicken nuggets. The biscuit compartment may include a shielding material on the sides, bottom, and/or top thereof to prevent the biscuit from drying out. The gravy compartment may include a susceptor material on the sides, bottom, and/or top thereof to promote rapid heating of the gravy. The food items within the package reach their desired respective serving temperatures in substantially the same amount of time.

As another example, a compartment may be provided for a primary food item, and another compartment may be provided for an accompanying secondary food item, for example, a condiment or dipping sauce. The compartment for the dipping sauce, for example, ketchup, may include a susceptor or other material on the sides, bottom, and/or top thereof, and the compartment for the food item, for example, French fries, may include the same or another microwave interactive element, for example, a microwave energy interactive insulating material, a microwave energy shielding element, or a microwave energy directing element on the sides, bottom, and/or top thereof.

Any of the packages according to the present invention may include various optional features including, for example, one or more venting apertures, slits, or other openings, "feet" or other elevating features, perforations, tear-open panels, tear-off panels, features that permit the package to be opened and re-sealed or re-closed, and so forth.

Additionally, it should be understood that the present invention contemplates constructs for single-serving portions and for multiple-serving portions. It also should be understood that various components used to form the constructs of the present invention may be interchanged. Thus, while only certain combinations are illustrated herein, numerous other combinations and configurations are contemplated hereby.

Various aspects of the present invention may be understood further by way of the following examples, which are not to be construed as limiting in any manner.

EXAMPLE 1

Figure 9:
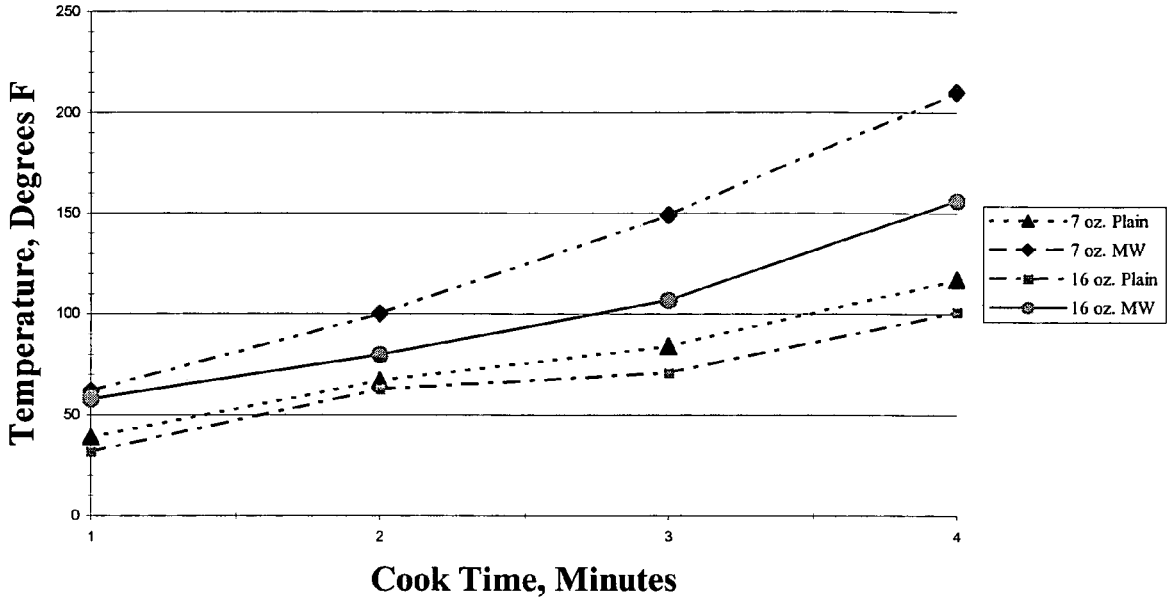
FIG. 9 provides the heating characteristics of water in various physical states in a microwave oven.

The ability of water in various states to absorb microwave energy was evaluated. Various bowls filled with water were frozen in a freezer maintained at a temperature of about 0° F. The filled bowls were heated in a Panasonic™ 1100 watt microwave oven at full power. At one-minute intervals, the temperature of the upper outer bowl, lower outer bowl, and water/ice were measured using a Luxtron fiber optic probe. The results are presented in Table 1 and FIG. 9

TABLE 1

| Bowl Type | Time (min) | Upper Bowl Temp (° F.) | Lower Bowl Temp (° F.) | Water Temp (° F.) |
|---|---|---|---|---|
| 7 oz. Paperboard | 1 | 98 | 153 | 39 |
| | 2 | 109 | 156 | 67 |
| | 3 | 116 | 160 | 84 |
| | 4 | 118 | 168 | 117 (ice chips) |
| 7 oz. Paperboard w/QUIKWAVE ® susceptor ("MW") | 1 | 96 | 250 | 62 |
| | 2 | 107 | 255 | 100 |
| | 3 | 110 | 252 | 149 |
| | 4 | 114 | 248 | 210 (no ice) |
| 16 oz. Paperboard | 1 | 95 | 156 | 37 |
| | 2 | 103 | 148 | 63 |
| | 3 | 111 | 151 | 71 |
| | 4 | 115 | 159 | 101 (large ice chunk) |
| 16 oz. Paperboard w/QUIKWAVE ® susceptor ("MW") | 1 | 92 | 194 | 58 |
| | 2 | 106 | 186 | 80 |
| | 3 | 112 | 220 | 107 |
| | 4 | 115 | 222 | 156 (small ice chunk) |

The results indicate that frozen water is a relatively poor absorber of microwave energy. In contrast, liquid water more effectively converts microwave energy into sensible heat. Furthermore, the frozen water heated more readily in the bowls that included the susceptor material, which readily converts microwave energy into sensible heat.

EXAMPLE 2

Figure 10:
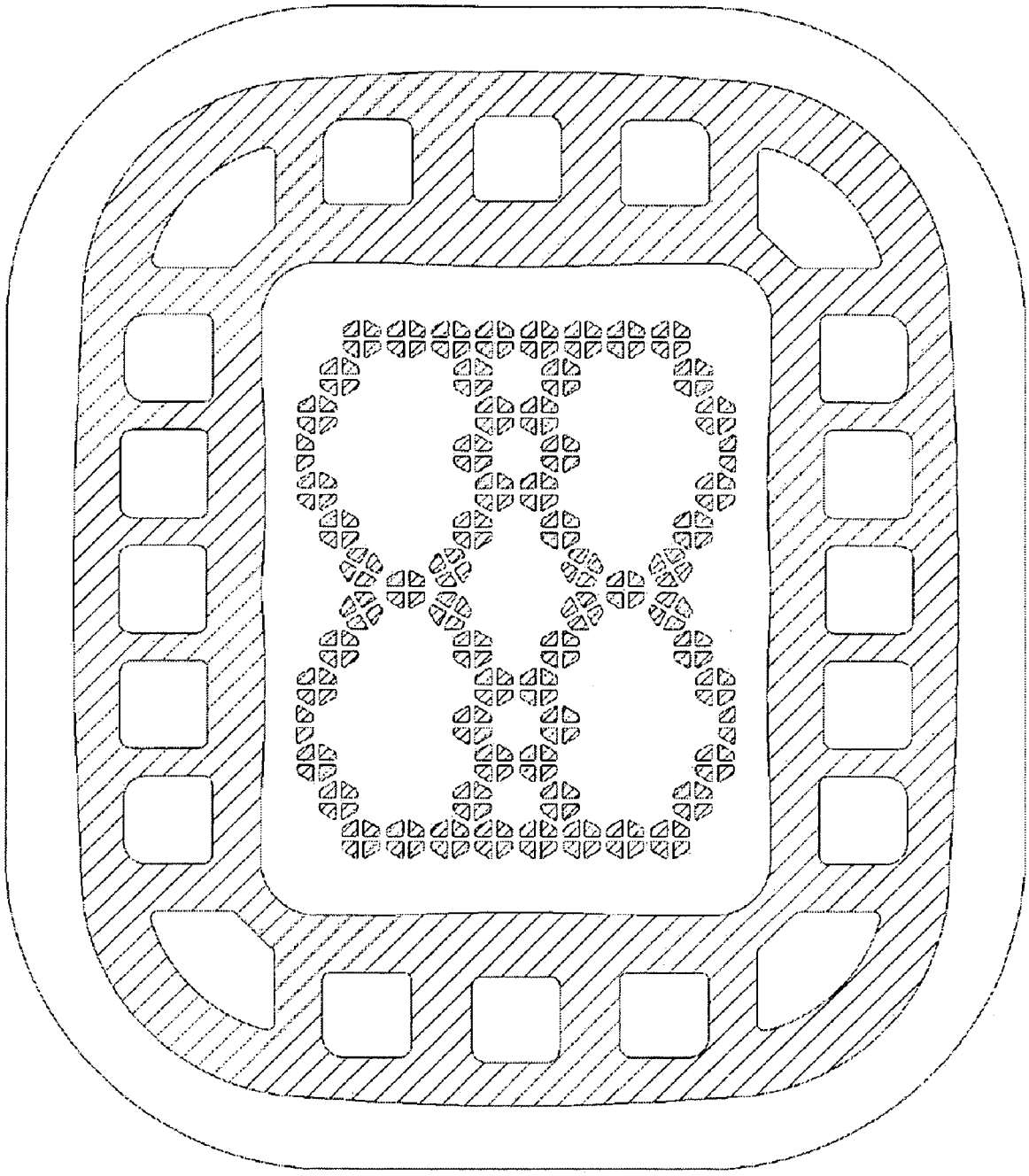
FIG. 10 depicts an exemplary construct used to conduct various product evaluations according to various aspects of the present invention.
Figure 11:
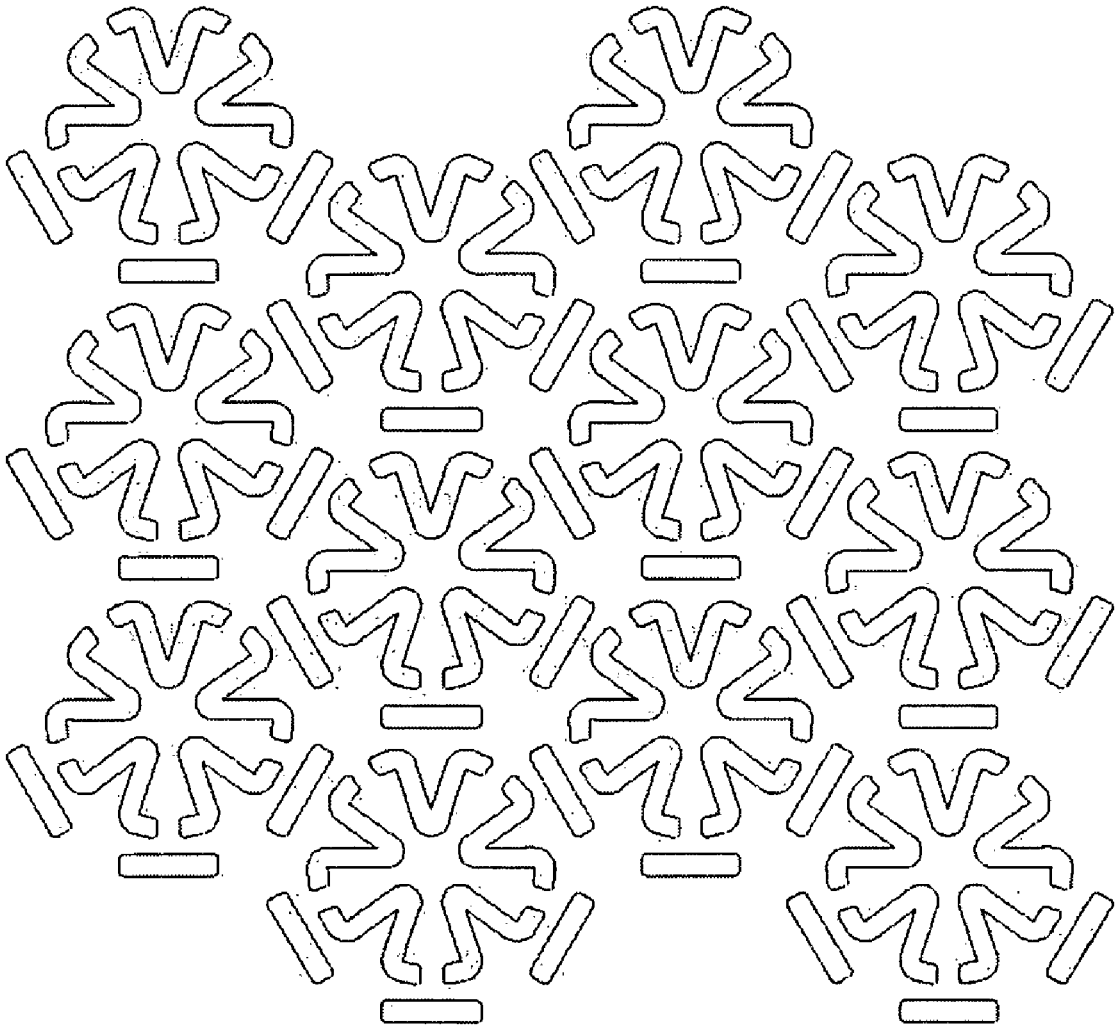
FIG. 11 depicts a patterned segmented foil used to conduct various product evaluations according to various aspects of the present invention.
Figure 12:
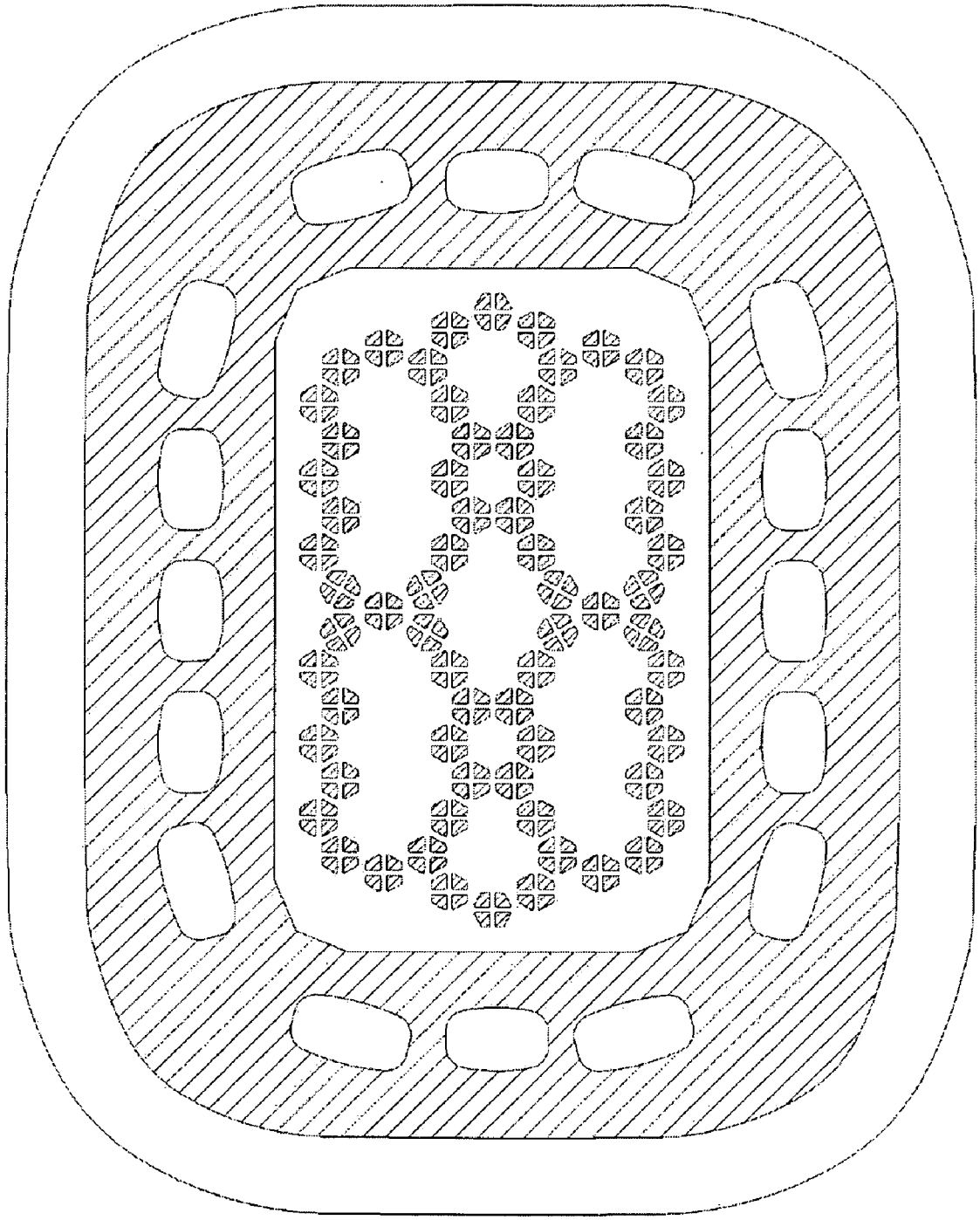
FIG. 12 depicts yet another exemplary construct used to conduct various product evaluations according to various aspects of the present invention.
Figure 13:
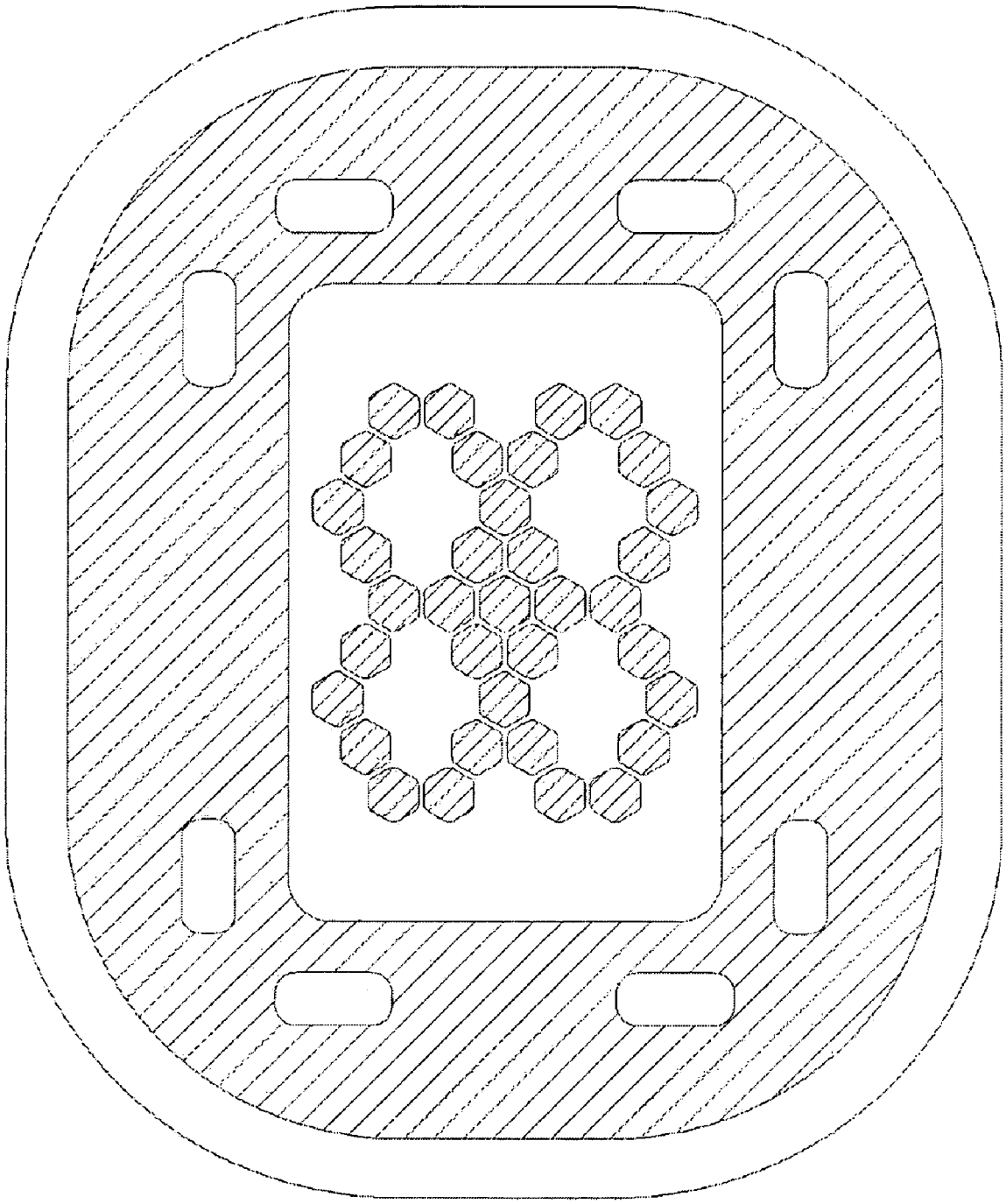
FIG. 13 depicts still another exemplary construct used to conduct various product evaluations according to various aspects of the present invention.

Various sandwiches were wrapped in different packaging materials. Campbell Soup™ chicken with rice soup was placed in various constructs. Both food, items were frozen to about 0° F. and placed beside each other in a Panasonic™ 1100 watt microwave oven and heated at full power for varying time intervals. The food items then were allowed to stand for about one minute. The temperature of the soup and sandwich were measured using Luxtron fiber optic probe. The quality of the bread was observed. The various materials used, package configurations, heating conditions, and results are presented in FIGS. 10-13 and Table 2, in which:

"Chicken Caesar" refers to a Panera Chicken Caesar sandwich;

"Chicken on . . ." refers to a sandwich prepared from Panera bread with 3 ounces of Louis Rich grilled chicken strips;

"PET" refers to 48 gauge polyethylene terephthalate film;

"MPET" refers to 48 gauge metallized polyethylene terephthalate film;

"excellent" results refers to thorough heating of the soup and proper heating, browning, and crisping of the sandwich;

"very good" results refers to thorough heating of the soup and sandwich, but somewhat insufficient browning and/or crisping of the sandwich bread;

"good" results refers to thorough heating of the soup, but insufficient heating, browning, and/or crisping of the sandwich;

"poor" results refers to insufficient heating of the soup and/or overheating, over-browning, or over-crisping of the sandwich; and "NA" results refer to results that are not available due to product failure, scorching of the food items, or some combination thereof, FIGS. 10, 12, and 13 present top plan views of the trays used in the various examples, with the metallic shielding elements indicated with hatch marks, modified as indicated in Table 2; and FIG. 11 depicts the pattern of the segmented foil, which overlied a susceptor, as used in various examples as indicated in Table 2.

The results indicate that the package of the present invention may be used effectively to heat multiple food items to their desired respective serving temperatures, including liquid food items.

TABLE 2

| | Soup | | | | | Full | Hold | | | | |
|---|---|---|---|---|---|---|---|---|---|---|---|
| | Bowl | | Sandwich | | | power | time | Soup | Bread | Meat | Sandwich |
| Test | (g) | capacity/type | Type | (g) | Packaging | (s) | (s) | (F) | (F) | (F) | quality |
| 1 | 212 | 16 oz SBS/PET | Chicken Caesar | 251 | QUILTWAVE ® susceptor pouch | 540 | 60 | 148-154 | 200 | 200 | Poor |
| 2 | 216 | 16 oz SBS/PET | Chicken Caesar | 252 | Multi-ply paper wrap (non-interactive) | 540 | 60 | 155-165 | 199 | 200 | Poor |
| 3 | 159 | 9 oz SBS/PET | Chicken Caesar | 240 | Multi-ply paper wrap (non-interactive) | 450 | 60 | 165-178 | 200 | 200 | Poor |
| 4 | 159 | 9 oz SBS/MPET | Chicken Caesar | 219 | Two opposed 900 $cm^3$ MICRORITE ® trays | 265 | NA | NA | NA | NA | NA |
| 5 | 150 | 9 oz SBS/MPET | Chicken Caesar | 240 | Sandwich in PET/paper/PET pouch, pouch in two | 310 | NA | 175-177 | 122-175 | NA | Excellent |

TABLE 2-continued

| Test | Soup (g) | Soup Bowl capacity/type | Sandwich Type | Sandwich (g) | Sandwich Packaging | Full power (s) | Hold time (s) | Soup (F) | Bread (F) | Meat (F) | Sandwich quality |
|---|---|---|---|---|---|---|---|---|---|---|---|
| | | | | | opposed 1000 $cm^3$ MICRORITE ® trays (FIG. 10) w/Al foil added to bottom of lower tray | | | | | | |
| 6 | 248 | 16 oz MICRORITE ® susceptor (FIG. 11) | Chicken Caesar | 240 | Sandwich in PET/paper/PET pouch, pouch in two opposed 1000 $cm^3$ MICRORITE ® trays (FIG. 10) w/Al foil added to bottom of lower tray | 390 | 60 | 165 | 146-177 | 80-163 | Excellent |
| 7 | 151 | 9 oz SBS/MPET | Chicken Caesar | 120 | Sandwich in PET/paper/PET pouch, pouch in two opposed 400 $cm^3$ MICRORITE ® trays | 240 | 60 | 168-173 | 85-180 | 79-128 | Poor |
| 8 | 240 | 16 oz MICRORITE ® susceptor (FIG. 11) | Chicken Caesar | 235 | Sandwich in PET/paper/PET pouch, pouch in 900 $cm^3$ MICRORITE ® molded rim tray (FIG. 12) w/paperboard sleeve w/Al foil patch in center of top | 390 | 60 | 180 | 182 | 28 | NA |
| 9 | 222 | 16 oz susceptor w/QUILTWAVE ® susceptor around outside | Chicken Caesar | 234 | Sandwich in PET/paper/PET pouch, pouch in 900 $cm^3$ MICRORITE ® molded rim tray (FIG. 12) w/paperboard sleeve w/Al foil patch in center of top | 390 | 60 | 175-185 | 140-164 | 32 | NA |
| 10 | 222 | 16 oz MICRORITE ® susceptor (FIG. 11) | Chicken Caesar | 234 | Sandwich in PET/paper/PET pouch, pouch in two opposed 1000 $cm^3$ MICRORITE ® trays (FIG. 10) | 390 | 60 | 148-156 | 100-150 | 31-105 | Good |
| 11 | 232 | 16 oz MICRORITE ® susceptor (FIG. 11) | Chicken Caesar, center pieces | 260 | Sandwich in PET/paper/PET pouch, pouch in two opposed 400 $cm^3$ MICRORITE ® trays (FIG. 13), w/one 1 in. hole cut in foil at center of trays | 390 | 60 | 145-157 | 90-112 | 27-45 | Good |
| 12 | 232 | 16 oz susceptor | Chicken Caesar, end pieces | 260 | Sandwich in PET/paper/PET pouch, pouch in two opposed 400 $cm^3$ MICRORITE ® trays (FIG. 13), w/three 1 in. holes cut in foil along center axis of trays | 390 | 60 | 145-149 | 108-170 | 62-170 | Excellent |
| 13 | 205 | 16 oz susceptor | Chicken on ciabatta | 270 | Sandwich in PET/paper/PET pouch, pouch in two opposed 400 $cm^3$ MICRORITE ® trays (FIG. 13), w/three 1 in. holes cut in foil along center axis of trays | 390 | 60 | 163-165 | 195-200 | 193-200 | Excellent |
| 14 | 146 | 9 oz SBS/MPET | Chicken on rye | 162 | Sandwich in PET/paper/PET pouch, pouch in two opposed 400 $cm^3$ MICRORITE ® trays (FIG. 13), w/three 1 in. holes cut in | 300 | 60 | 157-160 | 179-202 | 192-199 | Very good |

TABLE 2-continued

| Test | Soup (g) | Soup Bowl capacity/type | Sandwich Type | Sandwich (g) | Sandwich Packaging | Full power (s) | Hold time (s) | Soup (F) | Bread (F) | Meat (F) | Sandwich quality |
|---|---|---|---|---|---|---|---|---|---|---|---|
| 15 | 158 | 9 oz SBS/MPET | Chicken on wheat | 154 | foil along center axis of trays Sandwich in PET/paper/PET pouch, pouch in two opposed 400 $cm^3$ MICRORITE ® trays (FIG. 13), one 1 in. hole cut in foil along center of trays | 300 | 60 | 165-167 | 199 | 180-192 | Very good |

Although certain embodiments of this invention have been described with a certain degree of particularity, those skilled in the art could make numerous alterations to the disclosed embodiments without departing from the spirit or scope of this invention. All directional references (e.g., upper, lower, upward, downward, left, right, leftward, rightward, top, bottom, above, below, vertical, horizontal, clockwise, and counterclockwise) are used only for identification purposes to aid the reader's understanding of the various embodiments of the present invention, and do not create limitations, particularly as to the position, orientation, or use of the invention unless specifically set forth in the claims. Joinder references (e.g., joined, attached, coupled, connected, and the like) are to be construed broadly and may include intermediate members between a connection of elements and relative movement between elements. As such, joinder references do not necessarily imply that two elements are connected directly and in fixed relation to each other.

It will be recognized by those skilled in the art, that various elements discussed with reference to the various embodiments may be interchanged to create entirely new embodiments coming within the scope of the present invention. It is intended that all matter contained in the above description or shown in the accompanying drawings shall be interpreted as illustrative only and not limiting. Changes in detail or structure may be made without departing from the spirit of the invention as defined in the appended claims. The detailed description set forth herein is not intended nor is to be construed to limit the present invention or otherwise to exclude any such other embodiments, adaptations, variations, modifications, and equivalent arrangements of the present invention.

Accordingly, it will be readily understood by those persons skilled in the art that, in view of the above detailed description of the invention, the present invention is susceptible of broad utility and application. Many adaptations of the present invention other than those herein described, as well as many variations, modifications, and equivalent arrangements will be apparent from or reasonably suggested by the present invention and the above detailed description thereof, without departing from the substance or scope of the present invention.

While the present invention is described herein in detail in relation to specific aspects, it is to be understood that this detailed description is only illustrative and exemplary of the present invention and is made merely for purposes of providing a full and enabling disclosure of the present invention. The detailed description set forth herein is not intended nor is to be construed to limit the present invention or otherwise to exclude any such other embodiments, adaptations, variations, modifications, and equivalent arrangements of the present invention.

What is claimed is:

1. A packaging system for heating a plurality of food items in a microwave oven, the system comprising:

a tray including a first compartment and a second compartment, wherein the first compartment is adapted to receive a frozen first food item, the first food item being substantially a solid when the first food item is heated to its desired serving temperature, the first food item has an outer surface that is prone to overdrying when exposed to microwave energy and an inner area that is prone to underheating when exposed to microwave energy, and the first compartment includes a microwave energy shielding element positioned to be in a facing relationship with the outer surface of the first food item, and a microwave energy directing element adapted to direct microwave energy towards the inner area of the first food item; and a container dimensioned to be seated removably within the second compartment, wherein the container is adapted to receive a frozen second food item, the second food item being substantially a liquid or a semi-liquid when the second food item is heated to its desired serving temperature, the second food item is prone to underheating when exposed to microwave energy, the container includes at least one upstanding wall and a susceptor overlying at least a portion of the upstanding wall, and the microwave energy shielding element, microwave energy directing element, and the susceptor are configured to heat the first food item and the second food item to their respective desired serving temperatures in about the same amount of time.

2. The system of claim 1, further comprising an overwrap overlying at least a portion of the first compartment, wherein the overwrap comprises a microwave energy interactive material supported on a polymeric film.

3. The system of claim 1, wherein the outer surface of the first food item is intended to be browned and/or crisped, and the first compartment further includes a susceptor.

4. The system of claim 1, wherein the first food item is a dough-based food item.

5. The system of claim 1, wherein the first food item is a sandwich or a breaded food item.

6. The system of claim 1, wherein the second compartment further comprises a segmented foil.

7. The system of claim 1, wherein the susceptor circumscribes at least one physical or non-physical aperture.

8. The system of claim 1, wherein the second food item is a beverage, soup, sauce, or gravy.

9. The system of claim 8, wherein the first food item is a sandwich, and the second food item is a soup.

10. The system of claim 9, wherein the second compartment further comprises a segmented foil.

11. A system for heating a plurality of frozen food items in a microwave oven, the food items each responding differently to microwave energy and each having a desired serving temperature, the system comprising:

a tray having a plurality of compartments including at least a first compartment and a second compartment;

a first container dimensioned to be received removably within the first compartment, the first container including a plurality of adjoined, substantially planar faces, a microwave energy shielding element overlying at least a portion of one face of the plurality of adjoined, substantially planar faces, and a microwave energy directing element overlying at least a portion of one face of the plurality of adjoined, substantially planar faces, wherein the first container is adapted to receive a frozen first food item, the first food item being substantially a solid at the desired serving temperature of the first food item, the first food item having an outer area that is prone to overheating and an inner area that is prone to underheating when exposed to microwave energy, the microwave energy directing element is adapted to direct microwave energy towards the inner area of the first food item, and the microwave energy shielding element is adapted to reduce the transmission of microwave energy to at least a portion of the outer area of the first food item; and a second container dimensioned to be received within the second compartment, the second container including a wall extending upwardly from a base, and a susceptor overlying at least a portion of the wall, wherein the second container is adapted to contain a frozen second food item, the second food item being substantially a liquid or semi-liquid at the desired serving temperature of the second food item, the second food item being prone to underheating when exposed to microwave energy, wherein the microwave energy shielding element and the susceptor are configured to heat the first food item and the second food item to their respective desired serving temperatures in about the same amount of time.

12. The system of claim 11, wherein the first container is a flexible sleeve, pouch, or wrap.

13. The system of claim 11, wherein the outer surface of the first food item desirably is browned and/or crisped, and the first container further includes a susceptor.

14. The system of claim 11, wherein the first food item is a dough-based food item, a breaded food item, or any combination thereof.

15. The system of claim 11, wherein the first food item is a sandwich or a breaded meat.

16. The system of claim 11, wherein the first container further includes a susceptor, a segmented foil, or any combination thereof.

17. The system of claim 11, wherein the second container comprises a rigid or semi-rigid cup.

18. The system of claim 11, wherein the second container further includes a segmented foil overlying the base.

19. The system of claim 11, wherein the second food item is a beverage, soup, sauce, or gravy.

* * * * *